US007297455B2

(12) United States Patent
Fujikawa et al.

(10) Patent No.: US 7,297,455 B2
(45) Date of Patent: Nov. 20, 2007

(54) TONER, AND IMAGE FORMING METHOD

(75) Inventors: Hiroyuki Fujikawa, Kanagawa (JP); Yuko Sato, Shizuoka (JP); Nobuyoshi Sugahara, Shizuoka (JP); Takayuki Itakura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 10/900,177

(22) Filed: Jul. 28, 2004

(65) Prior Publication Data

US 2005/0026056 A1 Feb. 3, 2005

(30) Foreign Application Priority Data

Jul. 30, 2003 (JP) ..... 2003-203862
Dec. 1, 2003 (JP) ..... 2003-401422

(51) Int. Cl.
*G03G 13/00* (2006.01)
*G03G 9/00* (2006.01)

(52) U.S. Cl. ..... 430/45.1; 430/109.4; 430/108.4; 430/108.6

(58) Field of Classification Search ..... 430/45, 430/109.4, 108.4, 108.6, 45.1
See application file for complete search history.

(56) References Cited

U.S. PATENT DOCUMENTS 4,960,664 A 10/1990 Yamada et al. ..... 430/109
6,346,070 B1 2/2002 Ohmatsuzawa et al. .... 529/279
6,451,959 B1 9/2002 Ohmatsuzawa et al. .... 528/279
6,528,222 B2 3/2003 Kohtaki et al. ..... 430/108.21
6,586,147 B2 7/2003 Iida et al. ..... 430/45
7,029,813 B2 * 4/2006 Mikuriya et al. ..... 430/108.1
7,115,702 B2 * 10/2006 Terauchi et al. ..... 528/272
2002/0137879 A1 9/2002 Ohmatsuzawa et al. .... 528/279

FOREIGN PATENT DOCUMENTS

| | | |
|---|---|---|
| JP | 57-96056 | 6/1982 |
| JP | 1-185660 | 7/1989 |
| JP | 1-238672 | 9/1989 |
| JP | 4-107467 | 4/1992 |
| JP | 4-149559 | 5/1992 |
| JP | 4-301858 | 10/1992 |
| JP | 5-61238 | 3/1993 |
| JP | 2001-64378 | 3/2001 |
| JP | 2002-148867 | 5/2002 |

* cited by examiner

*Primary Examiner*—Mark A. Chapman
(74) *Attorney, Agent, or Firm*—Fitzpatrick, Cella, Harper & Scinto

(57) ABSTRACT

A toner is composed primarily of toner particles containing at least a binder resin, a colorant and a wax, and inorganic fine particles. The binder resin is one which has at least a polyester unit and is synthesized by using as a catalyst one or more compounds selected from titanium chelate compounds each having a specific structure and hydrates of the titanium chelate compounds. The toner has superior fixing performance and high-temperature anti-offset properties and is superior in charge stability even when used for a long time.

15 Claims, 2 Drawing Sheets

TONER, AND IMAGE FORMING METHOD

This application claims priority from Japanese Patent Application Nos. 2003-203862 filed Jul. 30, 2003 and 2003-401422 filed Dec. 1, 2003, which is hereby incorporated by reference herein.

BACKGROUND OF THE INVENTION

1. Field of the Invention

This invention relates to a toner used in image forming processes such as electrophotography, electrostatic printing, toner jet recording and magnetic recording, and an image forming method making use of the toner.

2. Related Background Art

With the spread of electrophotographic full-color image forming apparatus, a great variety of their uses have been developed, and a demand for image quality have now come severer. In the copying or printing of images such as catalogues and maps, the details thereof are required to be reproduced finely and faithfully. With such demands, a demand for the sharpness of colors also has been heightened, and it is desired to extend the range of color reproduction. In particular, in these days the advance of electrophotographic apparatus into the field of printing is marked, and also in electrophotographic systems, it has been required that colofulness, minuteness and graininess of image characteristics are improved to be at a level not lower than those in printing.

In recent years, in full-color image forming apparatus such as full-color copying machines having been proposed, commonly used are, e.g., a method in which, using a plurality of photosensitive members, electrostatic latent images formed respectively on the photosensitive members are developed with a cyan toner, a magenta toner, a yellow toner and a black toner to form corresponding toner images and then a transfer material is transported between the photosensitive members and a belt-like transfer member to transfer the toner images thereto in a straight pass, followed by fixing to form a full-color image, and a method in which the transfer material is wound around the surface of a cylindrical transfer member set opposite to a photosensitive member, by the aid of electrostatic force or by mechanical action of a gripper or the like, and the steps of development and transfer are carried out four times to obtain a full-color image.

Toners used in these full-color image forming apparatus such as full-color copying machines are required to be sufficiently color-mixed and be heat-fixed to a transfer material in the step of heat-and-pressure fixing, without damaging color reproducibility and transparency of overhead projector (OHP) images.

To meet such requirements, as binder resins used in toner particles, it is preferable to use resins having higher sharp-melt properties. In recent years, polyester resins are used as the resins having sharp-melt properties. As polymerization catalysts used for the production of polyester resins used in the binder resins of toner particles, tin type catalysts such as dibutyltin oxide and antimony type catalysts such as antimony trioxide have been in common use. These techniques are still not fully satisfactory because fixing performance such as low-temperature fixing performance or high-temperature anti-offset properties and color reproducibility such as color mixing performance or transparency are important as performances of toners in order to satisfy functions such as high speed, high image quality and high minuteness which are demanded in the full-color image forming apparatus such as copying machines for full-color images.

Accordingly, in Japanese Patent Applications Laid-open No. 2002-148867 and No. 2001-64378, techniques are disclosed in which titanates of aromatic diols are used as polymerization catalysts or solid titanium compounds are used as polymerization catalysts.

These proposals still have problems on fixing performance, color reproducibility and developing performance in some cases, and further improvement is necessary.

The use of the resins having sharp-melt properties usually tends to bring about a problem on high-temperature anti-offset properties because binder resins have a low self cohesive force when toners melt in the step of heat-and-pressure fixing. Accordingly, in order to improve the high-temperature anti-offset properties at the time of fixing, relatively highly crystalline waxes as typified by polyethylene wax and polypropylene wax are used as release agents.

However, especially in toners used in full-color images, because of such a high crystallizability of the release agents themselves and a difference in refractive index between toners and OHP sheet materials, the transparency may be damaged when projected through OHPs, resulting in a low chroma or brightness of projected images.

Accordingly, in order to solve such problems, as disclosed in Japanese Patent Applications Laid-open No. H4-149559 and No. H4-107467, a method is proposed in which a nucleating agent and a wax are used in combination to lower the crystallizability of the wax. As also disclosed in Japanese Patent Applications Laid-open No. H4-301858 and No. H5-61238, a method is further proposed in which a wax having low crystallinity is used. As other waxes, as disclosed in Japanese Patent Applications Laid-open No. H1-185660 and No. H1-238672, it is proposed to use montan type waxes as waxes having relatively good transparency and low melting points. These waxes, however, are not those which can satisfy all the transparency on OHPs, the low-temperature fixing performance at the time of heat-and-pressure fixing and the high-temperature anti-offset properties.

SUMMARY OF THE INVENTION

An object of the present invention is to solve the above problems and to provide a toner having superior fixing performance and high-temperature anti-offset properties, and an image forming method making use of the toner.

Another object of the present invention is to provide a toner improved in the dispersibility of colorant in toner particles and having superior color reproducibility such as color mixing performance or transparency, and an image forming method making use of the toner.

Still another object of the present invention is to provide a toner which is superior in the running (extensive operation) stability of chargeability and can form images having high quality, and an image forming method making use of the toner.

As a result of extensive studies, the present inventors have discovered that when using a resin synthesized using a certain specific polymerization catalyst, the above demands can be filfilled, and have accomplished the present invention. That is, the above objects can be achieved by the use of the following toner and image forming method.

Thus, the present invention provides a toner having toner particles containing at least a binder resin, a colorant and a wax, and inorganic fine particles, wherein the binder resin is a resin having at least a polyester unit;

the binder resin having a polyester unit is a resin synthesized by using as a catalyst one or more compounds selected from the group consisting of a titanium chelate compounds each having a structure represented by any one of the following Formulas (I) to (VI), and hydrates of the titanium chelate compounds.

(I)

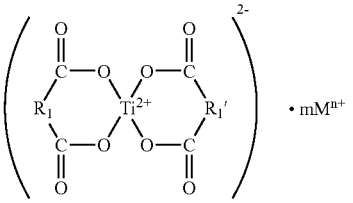

In the above Formula (I), $R_1$ and $R_1'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(II)

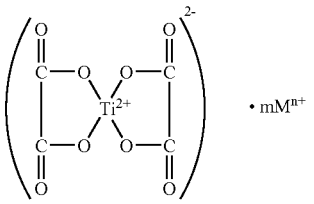

In the above Formula (II), M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(III)

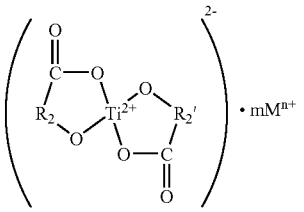

In the above Formula (III), $R_2$ and $R_2'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(IV)

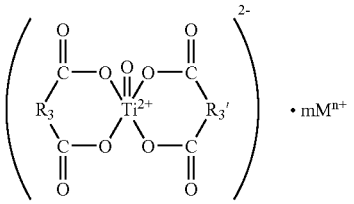

In the above Formula (IV), $R_3$ and $R_3'$ each independently represent an alkylene group having 1 to 10 carbon atoms which may be substituted, or an alkenylene group having 1 to 10 carbon atoms which may be substituted; and M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(V)

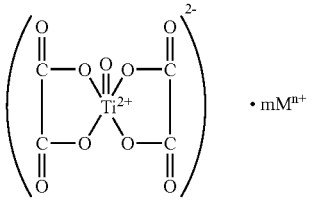

In the above Formula (V), M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(VI)

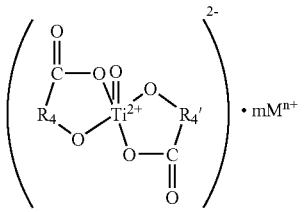

In the above Formula (VI), $R_4$ and $R_4'$ each independently represent an alkylene group having 1 to 10 carbon atoms which may be substituted, or an alkenylene group having 1 to 10 carbon atoms which may be substituted; and M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

The present invention also provides an image forming method having at least:

a charging step of applying a voltage to a charging member to charge an image bearing member;

an electrostatic latent image formation step of forming an electrostatic latent image on the image bearing member thus charged;

a developing step of developing the electrostatic latent image by the use of a toner held on the surface of a toner carrying member, to form a toner image on the surface of the image bearing member;

a transfer step of transferring the toner image formed on the image bearing member, to a transfer material via, or not via, an intermediate transfer member; and a fixing step of fixing the toner image by heat and pressure;

the toner having at least toner particles containing at least a binder resin, a colorant and a wax, and inorganic fine particles;

wherein;

the binder resin is a resin having at least a polyester unit, and the binder resin having a polyester unit is a resin synthesized by using as a catalyst one or more compounds selected from the group consisting of titanium chelate compounds each having a structure represented by any one of the following Formulas (I) to (VI), and hydrates of the titanium chelate compounds.

(I)

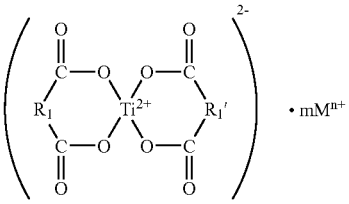

In the above Formula (I), $R_1$ and $R_1'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(II)

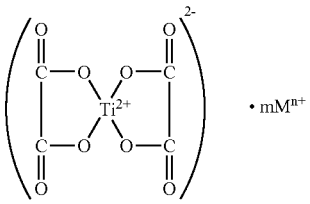

In the above Formula (II), M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(III)

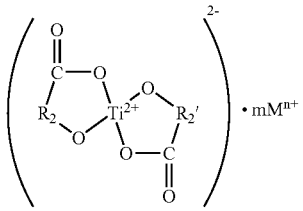

In the above Formula (III), $R_2$ and $R_2'$ each independently represent an alkylene group having 1 to 10 carbon atoms which may be substituted, or an alkenylene group having 1 to 10 carbon atoms which may be substituted; and M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(IV)

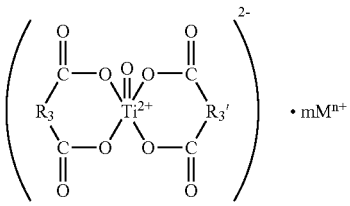

In the above Formula (IV), $R_3$ and $R_3'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(V)

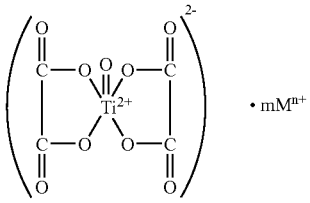

In the above Formula (V), M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(VI)

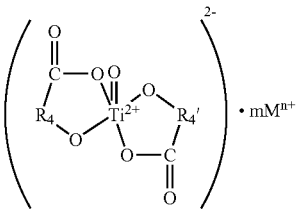

In the above Formula (VI), $R_4$ and $R_4'$ each independently represent an alkylene group having 1 to 10 carbon atoms which may be substituted, or an alkenylene group having 1 to 10 carbon atoms which may be substituted; and M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

According to the present invention, it is possible to provide a toner which is superior in fixing performance and high-temperature anti-offset properties, has been improved in the dispersibility of colorant in toner particles to have superior color reproducibility such as color mixing performance or transparency, and also is superior in running stability of chargeability to form images having high image quality; and an image forming method making use of such a toner.

DESCRIPTION OF THE PREFERRED EMBODIMENTS

Figure 1:
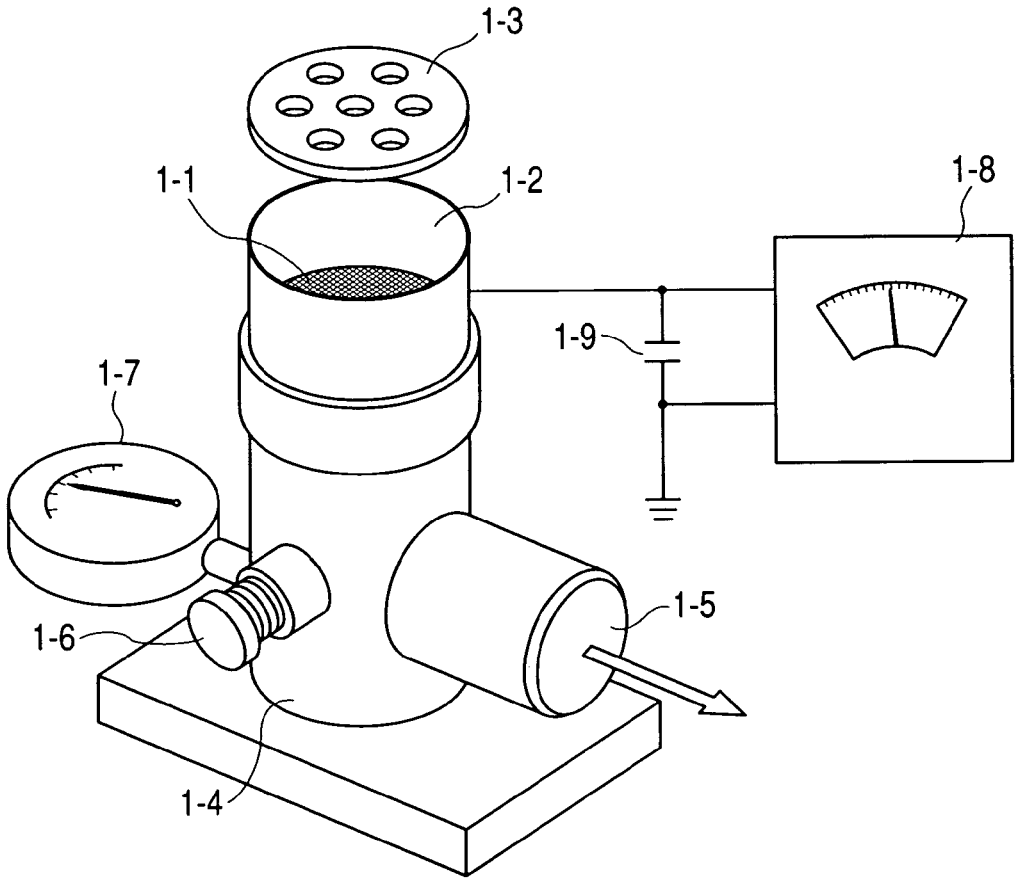
FIG. 1 illustrates a device which measures the triboelectric charge quantity of a two-component developer.

The present invention is described below in detail.

The toner of the present invention has toner particles containing at least a binder resin, a colorant and a wax, and inorganic fine particles, and the binder resin is a resin having at least a polyester unit.

As components constituting the polyester unit (hereinafter also "polyester unit components") used in the present invention, they are specifically meant to be dihydric or more polyhydric alcohol monomers, and acid monomers such as dibasic or more polybasic carboxylic acids, dibasic or more polybasic carboxylic anhydrides and dibasic or more polybasic carboxylates.

The toner of the present invention is characterized in that a resin is used having a moiety formed through polycondensation using those polyester unit components as part of raw materials.

The binder resin used in the toner of the present invention may preferably be a resin selected from i) a polyester resin, ii) a hybrid resin having a polyester unit and a vinyl polymer unit, iii) a mixture of the hybrid resin and a vinyl polymer, iv) a mixture of the hybrid resin and a polyester resin, v) a mixture of a polyester resin, the hybrid resin and a vinyl polymer, and vi) a mixture of a polyester resin and a vinyl polymer.

The hybrid resin is a resin formed by ester interchange reaction of polyester unit components with a vinyl polymer unit made up by polymerizing a monomer having a carboxylate group such as acrylate or methacrylate, which is preferably a graft copolymer (or block copolymer) composed of the vinyl polymer unit as the backbone polymer and the polyester unit as the branch polymer.

Referring to the dihydric or more polyhydric alcohol monomer which is one of the polyester unit components, stated specifically, as a dihydric alcohol component, it may include, e.g., bisphenol-A alkylene oxide addition products such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or more polyhydric alcohol component, it may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a dibasic carboxylic acid monomer, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 18 carbon atoms or an alkenyl group having 6 to 18 carbon atoms, or anhydrides thereof; and unsaturated dicarboxylic acids such as fumaric acid, maleic acid and citraconic acid, or anhydrides thereof.

As a tribasic carboxylic acid monomer, it may include polycarboxylic acids such as trimellitic acid, pyromellitic acid and benzophenonetetracarboxylic acid, or anhydrides thereof.

As other monomers, they may include polyhydric alcohols such as oxyalkylene ethers of novolak type phenol resin.

Of these, particularly preferred is a resin which is obtainable by polycondensation of the polyester unit components having as the dihydric alcohol monomer a bisphenol derivative represented by the following Formula (1) and as an acid component a dibasic or more polybasic carboxylic acid (e.g., fumaric acid, maleic acid, maleic anhydride, phthalic acid, terephthalic acid, trimellitic acid or pyromellitic acid) or an acid anhydride thereof or a lower alkyl ester thereof, because it affords good charge characteristics:

(1)

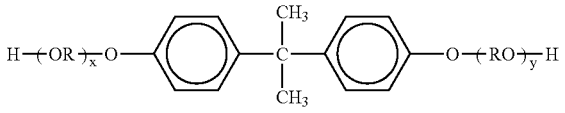

wherein R represents an ethylene group or a propylene group, x and y are each an integer of 1 or more, and an average value of x+y is 2 to 10.

The binder resin contained in the toner of the present invention may be a resin having at least the polyester unit, where the polyester unit components contained in the whole binder resin in the toner may be in an amount of 30% by weight or more based on the whole binder resin in the toner. This is preferable in order to bring out the effect of the present invention. The polyester unit component may more preferably be in an amount of 40% by weight or more, and particularly preferably 50% by weight or more.

Where the polyester unit components contained in the whole binder resin in the toner is in an amount of 30% by weight or more, the dispersibility of colorant in toner particles are improved, so that a toner can be obtained which has superior color reproducibility such as toner color mixing performance or transparency in fixed images and also has a high covering power on transfer materials. This is effective especially when pigment contents are large as in a colorant master batch.

As a vinyl monomer for forming the vinyl polymer unit or vinyl polymer used in the hybrid resin, it may include the following: Styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

The vinyl polymer or vinyl polymer unit used in the hybrid resin may have a cross-linked structure cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl)propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

It is preferable for the hybrid resin used in the present invention that the vinyl polymer or vinyl polymer unit and/or the polyester resin or polyester unit is/are incorporated with a monomer capable of reacting with both the resin components. Among monomers constituting the polyester resin or polyester unit, a monomer capable of reacting with the vinyl polymer or vinyl polymer unit may include, e.g., unsaturated dicarboxylic acids such as fumaric acid, maleic acid, citraconic acid and itaconic acid, or anhydrides thereof. Among monomers constituting the vinyl polymer or vinyl polymer unit, a monomer capable of reacting with the polyester resin or polyester unit may include monomers having a carboxyl group or a hydroxyl group, and acrylates or methacrylates.

As a method for obtaining the reaction product of the vinyl polymer with the polyester resin, preferred is a method in which polymerization reaction for any one or both of the polymers or resins is carried out in the presence of the above monomers capable of respectively reacting with the vinyl polymer and the polyester resin.

As a polymerization initiator used when the vinyl polymer or vinyl polymer unit according to the present invention is used, it may include, e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexane-1-carbonitrile), 2-(carbamoylazo)isobutyronitrile, 2,2'-azobis-(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

Methods by which the hybrid resin used in the present invention can be produced may include, e.g., the following production methods shown in (1) to (6).

(1) A method of blending a vinyl polymer and a polyester resin after they have independently been produced. Blending is carried out by dissolving and swelling them in an organic solvent such as xylene, and distilling off the organic solvent. In addition, the hybrid resin having a polyester unit and a vinyl polymer unit can be synthesized as follows: separately producing a vinyl polymer unit and a polyester unit, and thereafter dissolving and swelling them in a small amount of organic solvent, followed by addition of an esterifying catalyst and an alcohol and then heating to effect ester interchange reaction.

(2) A method of producing a vinyl polymer, then producing a polyester resin in the presence of the vinyl polymer, and allowing the vinyl polymer to react with the polyester resin to produce the hybrid resin having a polyester unit and a vinyl polymer unit. The hybrid resin is produced by allowing the vinyl polymer (a vinyl monomer may optionally be added) to react with a polyester monomer (such as an alcohol or a carboxylic acid) and/or a polyester resin. Also in this case, an organic solvent may appropriately be used.

(3) A method of producing a polyester resin, then producing a vinyl polymer in the presence of the polyester unit, and allowing the polyester resin to react with the vinyl polymer to produce the hybrid resin having a polyester unit and a vinyl polymer unit. The hybrid resin is produced by allowing the polyester resin (a polyester monomer may optionally be added) to react with a vinyl monomer and/or the vinyl polymer.

(4) A vinyl polymer and a polyester resin are produced, and in the presence of the vinyl polymer and the polyester resin, a vinyl monomer and/or a polyester monomer (such as an alcohol or a carboxylic acid) is/are added to produce the hybrid resin. Also in this case, an organic solvent may appropriately be used.

(5) After the hybrid resin having a polyester unit and a vinyl polymer unit is produced, a vinyl monomer and/or a polyester monomer such as an alcohol or a carboxylic acid is/are added to effect addition polymerization and/or polycondensation reaction, producing a vinyl polymer and/or a polyester resin, or further producing a hybrid resin. In this case, as the hybrid resin having a polyester unit and a vinyl polymer unit, the hybrid resins produced by the above methods (2) to (4) may be used, or optionally a hybrid resin produced by any conventional method may also be used. In addition, an organic solvent may appropriately be used.

(6) A vinyl monomer and a polyester monomer such as an alcohol or a carboxylic acid are mixed to effect addition polymerization and polycondensation reaction continuously to produce a vinyl polymer, a polyester resin and the hybrid resin having a polyester unit and a vinyl polymer unit. In addition, an organic solvent may appropriately be used.

In the above production processes (1) to (6), a plurality of polymer units having different molecular weights and different degrees of cross-linking may be used as the vinyl copolymer unit and/or the polyester unit.

In the present invention, the vinyl polymer refers to a vinyl homopolymer or a vinyl copolymer, and the vinyl copolymer unit refers to a vinyl homopolymer unit or a vinyl copolymer unit.

The toner of the present invention is characterized in that in the binder resin, the resin having a polyester unit is a resin synthesized using as a catalyst one or more compound(s) selected from the group consisting of a titanium chelate compound having a structure represented by any one of the following Formulas (I) to (VI), and a hydrate of the titanium chelate compound.

(I)

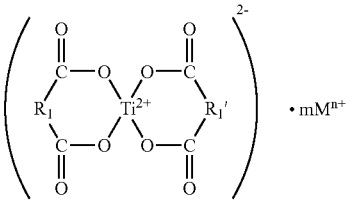

In the above Formula (I), $R_1$ and $R_1'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(II)

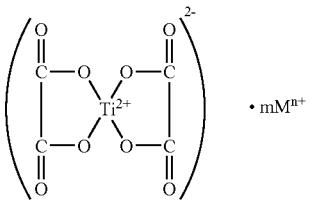

In the above Formula (II), M represents a counter cation, m represents the number of cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(III)

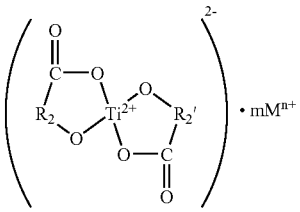

In the above Formula (III), $R_2$ and $R_2'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(IV)

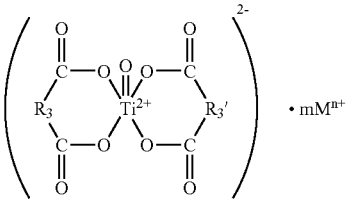

In the above Formula (IV), $R_3$ and $R_3'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(V)

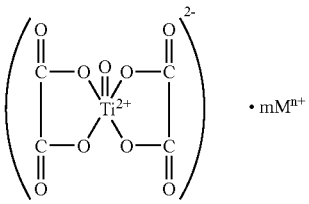

In the above Formula (V), M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

(VI)

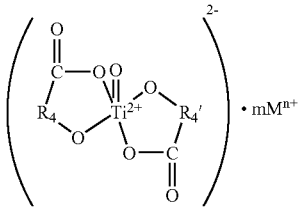

In the above Formula (VI), $R_4$ and $R_4'$ each independently represent an alkylene group having 1 to 10 carbon atoms which may be substituted, or an alkenylene group having 1 to 10 carbon atoms which may have a substituent; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

In addition, in the present invention, as the catalyst used in synthesizing the polyester unit, two types or more of compounds may be used which are selected from the group consisting of the titanium chelate compound having a structure represented by any of the above Formulas (I) to (VI), and a hydrate of the titanium chelate compound.

The use of the resin having a polyester unit according to the present invention improves the dispersibility of colorant in toner particles, so that a toner can be obtained having superior color reproducibility such as toner color mixing performance or transparency in fixed images and also has a high covering power on transfer materials. This is effective especially when pigment contents are large as in a colorant master batch. The above effect can be brought about because the resin according to the present invention has been synthesized using the titanium chelate compound as a catalyst. The reason therefor is presumed to be that the presence of the titanium chelate compound in the toner increases affinity for the colorant to bring about the effect of improving the dispersibility of colorant in the resin.

In the titanium chelate compound used in the present invention, it is preferable that the ligand is a dicarboxylic acid or an oxycarboxylic acid. Of these, it is particularly preferable that the ligand is an aliphatic dicarboxylic acid or an aliphatic oxycarboxylic acid. Aliphatic-type ligands have a stronger catalytic activity than aromatic-type ligands, and are preferred in view of the shortening of reaction time and the control of temperature.

The ligand may specifically include, as the dicarboxylic acid, oxalic acid, malonic acid, succinic acid, glutaric acid, adipic acid and maleic acid; and, as the oxycarboxylic acid, glycolic acid, lactic acid, hydroxyacrylic acid, α-oxybutyric acid, glyceric acid, tartronic acid, malic acid, tartaric acid and citric acid.

In particular, in the titanium chelate compound, the $R_1$, $R_1'$, $R_2$, $R_2'$, $R_3$, $R_3'$, $R_4$ and $R_4'$ in the above Formulas (I), (III), (IV) and (VI) may each be an alkylene group having 1 to 10 carbon atoms or an alkenylene group having 1 to 10 carbon atoms. This is preferable in view of development stability. It is also preferable that the titanium chelate compound is a compound represented by the above Formula (I), (II), (IV) or (VI) or a hydrate thereof. This is preferable because the toner can have superior running stability of chargeability to form images having maintained high image quality.

As the counter cation M in Formulas (I) to (VI), an alkali metal is preferred, and the alkali metal may include lithium, sodium, potassium, rubidium and cesium. Of these, preferred are lithium, sodium and potassium, and particularly preferred are sodium and potassium.

The titanium chelate compound and the hydrate of the titanium chelate compound may each be added in an amount of from 0.01% by weight or more to 2% by weight or less, and more preferably from 0.05% by weight or more to 1% by weight or less, as the total sum based on the weight of the polyester unit. If added in an amount of less than 0.01% by weight, the reaction time may be lengthened when the polyester is produced by polymerization and also the effect of improving the dispersibility of colorant may not be obtained. If on the other hand added in an amount of more than 2% by weight, the charging performance of the toner may be affected, tending to increase variation of charge quantity depending on environment.

In the toner of the present invention, besides the titanium chelate compounds and the hydrate of the titanium chelate compounds, a promoter also may optionally be used.

As the promoter, titanium chelate compounds of different types may be added, and preferably used are compounds of elements such as beryllium, magnesium, calcium, strontium barium, titanium, zirconium, manganese, cobalt, zinc, boron, aluminum, gallium, phosphor and tin. As examples of the compounds of these elements, preferably used are fatty acid salts (such as acetates), carbonates, sulfates and nitrates, or alkoxide salts, or halides (such as chlorides), or acetylacetonato salts or oxides.

Of these, preferred are acetates, carbonates, alkoxide salts, halides or acetylacetonato salts, particularly titanium alkoxide, titanium tetrachloride, zirconium alkoxide, magnesium carbonate or magnesium acetate.

The use of such a promoter is preferable because coexistence with the titanium chelate compound and/or the hydrate of the titanium chelate compound allows polycondensation reaction to proceed quickly.

Any of these promoters may be used in an amount ranging from 0.01% by weight to 200% by weight based on the total weight of the titanium chelate compound and/or the hydrate of the titanium chelate compound.

Specific examples of the titanium chelate compound used in the present invention are shown below.

Exemplary Compound 1

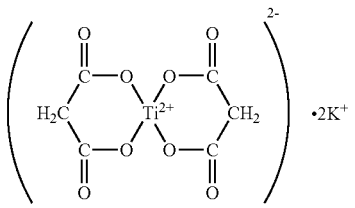

Exemplary Compound 2

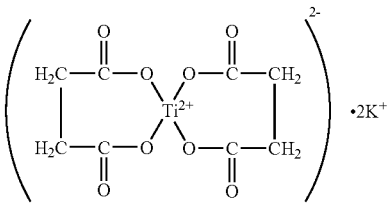

Exemplary Compound 3

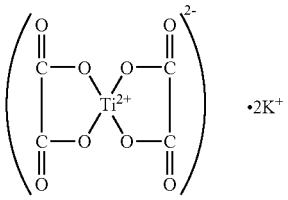

Exemplary Compound 4

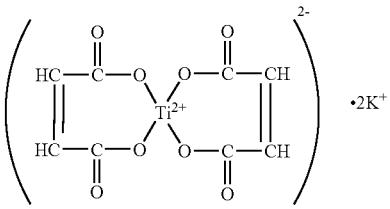

Exemplary Compound 5

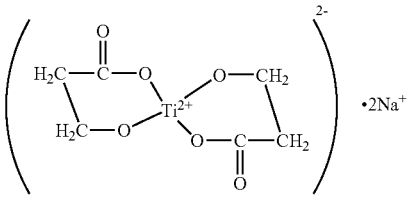

Exemplary Compound 6

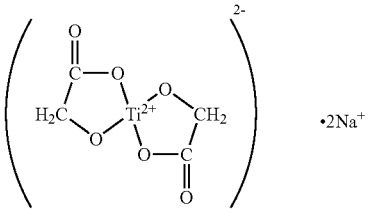

-continued

Exemplary Compound 7

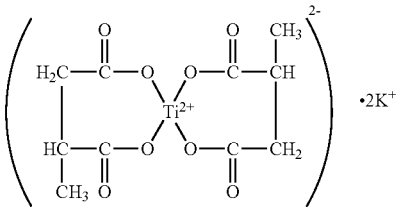

Exemplary Compound 8

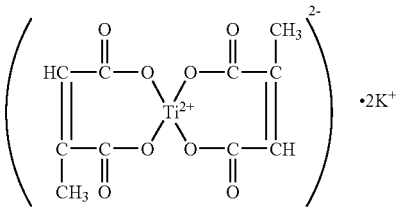

Exemplary Compound 9

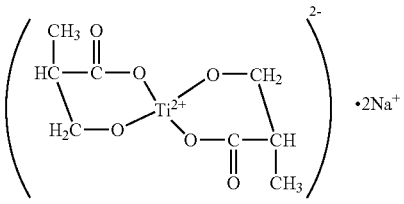

Exemplary Compound 10

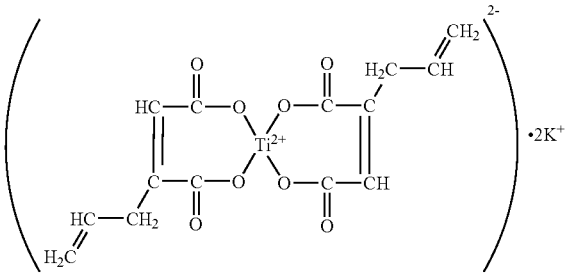

Exemplary Compound 11

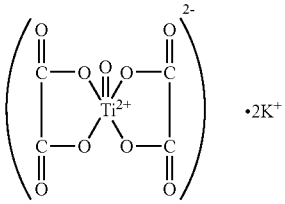

Exemplary Compound 12

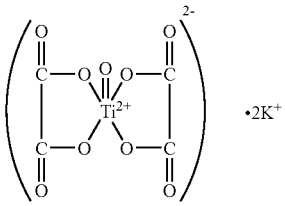

-continued

Exemplary Compound 13

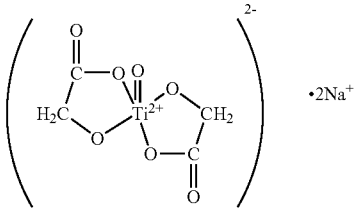

Exemplary Compound 14

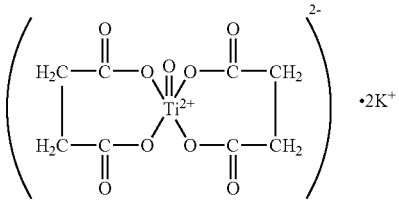

Exemplary Compound 15

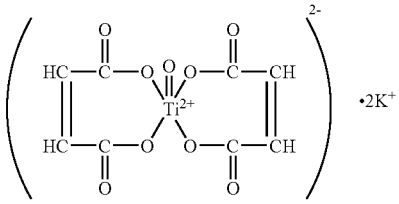

Exemplary Compound 16

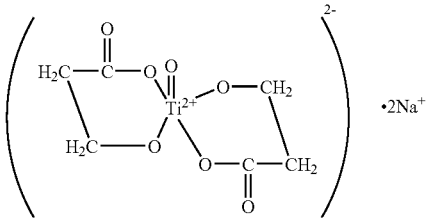

The resin having a polyester unit according to the present invention may preferably have, in a molecular weight distribution as measured by gel permeation chromatography (GPC), a main peak in the region of molecular weight of from 3,500 to 15,000, and more preferably in the region of molecular weight of from 4,000 to 13,000. The resin having a polyester unit according to the present invention may likewise preferably have, in a molecular weight distribution as measured by gel permeation chromatography (GPC), a ratio of weight-average molecular weight (Mw) to number-average molecular weight (Mn), Mw/Mn, of 3.0 or more, and more preferably 5.0 or more. If the resin has a main peak in the region of molecular weight of less than 3,500, the toner may have insufficient high-temperature anti-offset properties. If on the other hand it has a main peak in the region of molecular weight of more than 15,000, the toner may have insufficient low-temperature fixing performance and also may have low OHP transparency. If the resin has an Mw/Mn of less than 3.0, anti-offset properties is lowered.

The resin having a polyester unit according to the present invention may also preferably have a glass transition temperature (Tg) of from 40° C. to 90° C., and the resin having a polyester unit according to the present invention may have a softening temperature (Tm) of from 80° C. to 150° C., which is preferable in order to achieve all of the storage stability, the low-temperature fixing performance, the high-temperature anti-offset properties and the dispersibility of colorant.

The resin having a polyester unit may also have an acid value of less than 50 mg·KOH/g. This is preferable in order to improve the development running performance and the dispersibility of colorant.

The toner of the present invention is characterized by containing a wax.

In the present invention, the resin having a polyester unit, synthesized using as a catalyst the titanium chelate compound having the specific structure, is used in combination with the wax. This leads color reproducibility on the transfer material to be improved. In particular, images having high brightness and chroma can be obtained without degrading the transparency in OHP images. Also, the toner can achieve both the low-temperature fixing performance and the anti-offset properties. The reason therefor is presumed to be that in toner particles, the titanium chelate compound uniformly dispersed in the resin acts as a nucleating agent of the wax when the wax is dispersed by melt kneading in the presence of the titanium chelate compound, and hence the dispersibility of the wax can be improved. As the result, in the toner particles, the state of fine dispersion of the wax can be achieved, so that the images having high brightness and chroma can be obtained without making poor the transparency in OHP images.

Examples of the wax used in the present invention may include the following: aliphatic hydrocarbon waxes such as low-molecular weight polyethylene, low-molecular weight polypropylene, alkylene copolymers, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax, behenyl behenate wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, seryl alcohol and melissyl alcohol; fatty acid amides such as linolic acid amide, oleic acid amide and lauric acid amide; saturated fatty acid bisamides such as methylene bis(stearic acid amide), ethylene bis(capric acid amide), ethylene bis(lauric acid amide) and hexamethylene bis(stearic acid amide); unsaturated fatty acid amides such as ethylene bis(oleic acid amide), hexamethylene bis(oleic acid amide), N,N'-dioleyladipic acid amide and N,N'-dioleylsebasic acid amide; aromatic bisamides such as m-xylene bisstearic acid amide and N,N'-distearylisophthalic acid amide; fatty acid metal salts (those commonly called metal soap) such as calcium stearate, calcium laurate, zinc stearate and magnesium stearate; waxes grafted using vinyl monomers such as styrene and acrylic acid, to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

Waxes particularly preferably usable in the present invention may include aliphatic hydrocarbon waxes, and esterified products which are esters of fatty acids with alcohols. For example, preferred are low-molecular weight alkylene polymers obtained by polymerizing alkylenes by radical polymerization under high pressure, or by polymerization under low pressure in the presence of a Ziegler catalyst or a metallocene catalyst; alkylene polymers obtained by thermal decomposition of high-molecular weight alkylene polymers; and synthetic hydrocarbon waxes obtained from, or by hydrogenation of, distillation residues of hydrocarbons obtained by the Arge process from synthetic gases containing carbon monoxide and hydrogen. Hydrocarbon waxes fractionated by using press sweating, solvent fractionation or vacuum distillation, or by a fractionation recrystallization method may more preferably be used.

The hydrocarbons, serving as a matrix, may include those synthesized by reacting carbon monoxide with hydrogen in the presence of a metal oxide type catalyst (preferably, two or more kinds of multinary metal oxide type catalysts), as exemplified by hydrocarbon compounds obtained by the Synthol process or the Hydrocol process (making use of a fluidized catalyst bed); hydrocarbons having about several hundred carbon atoms, obtained by the Arge process (making use of a fixed catalyst bed) which can obtain waxy hydrocarbons in a large quantity; and hydrocarbons obtained by polymerization of alkylenes such as ethylene in the presence of a Ziegler catalyst; all of which are preferable as having less and small branches and being saturated long straight chain hydrocarbons. In particular, waxes synthesized by the method not relying on the polymerization of alkylenes are preferred in view of their molecular weight distribution. Paraffin wax may also preferably be used.

The wax used in the present invention may preferably have, in an endothermic curve in measurement by differential thermal analysis (or differential scanning calorimetry DSC), a maximum endothermic peak in the range of temperature of from 30° C. to 200° C. and a peak temperature thereof in the range of from 60° C. to 130° C., more preferably in the range of from 65° C. to 125° C., and still more preferably in the range of from 65° C. to 110° C.

Where the peak temperature of the maximum endothermic peak is in the range of from 60° C. to 130° C., the state of appropriate fine dispersion of the wax in toner particles can be achieved, and this is preferable in order to bring out the effect of the present invention. Meanwhile, if the peak temperature of the maximum endothermic peak is less than 60° C., the toner may have poor anti-offset properties. If on the other hand the peak temperature of the maximum endothermic peak is more than 130° C., the toner tends to have poor fixing performance.

The toner of the present invention has a light transmittance (%) of 600 nm wavelength light from 10% to 70%, more preferably from 10% to 60%, and still more preferably from 15% to 50%, in an aqueous solution containing methanol 45 vol. %.

The toner of the present invention has the wax incorporated in the toner particles, and hence the wax is present at least on the toner particle surfaces. If the wax is present at the toner particle surfaces in a small quantity, the release effect at the time of fixing may be difficult to bring about, lowering low-temperature fixing performance desired from the viewpoint of energy saving. If on the other hand the wax is present on the toner particle surfaces in a large quantity, the wax may contaminate charge-providing members. For example, it may melt-adhere onto the developing sleeve to increase the electric resistance of the sleeve high-resistance and reduce the effect of actual development bias for the development, lowering image density, and as a result, development running performance (or development durability) deteriorates in some cases. Thus, when the toner particles are incorporated with the wax, it is important to control the quantity of the wax at the toner particle surfaces.

Accordingly, in the present invention, the resin having a polyester unit, synthesized using as a catalyst the titanium chelate compound, is used in combination with the wax, whereby the state of fine dispersion of the wax in toner particles can be achieved to make it possible to control the quantity of the wax at the toner particle surfaces even when the wax is added in a large quantity.

The quantity of the wax at the toner particle surfaces can be measured simply and in a high precision, by measuring transmittance (%) of light in a liquid dispersion prepared by dispersing the toner in an aqueous solution of 45% by volume of methanol.

This measuring method can accurately find the quantity of the wax at the toner particle surfaces, by compelling toner particles to disperse into a methanol-water mixed solvent to make it easy to specify particle by particle the quantity of the wax at the toner surfaces, and measuring the transmittance after a certain time has passed.

That is, when the wax, which is hydrophobic, is present at the toner particle surfaces in a large quantity, the toner standing dispersed cannot be easily wetted by the solvent and does not settle, and hence the transmittance comes to be as large as 70%. On the other hand, when the wax is present at the toner particle surfaces in a small quantity, such a resin as containing the polyester unit is present in a large quantity has so strong a polarity as to exhibit hydrophilicity, where the toner is uniformly dispersed in the 45 vol % methanol aqueous solution, so that the transmittance comes to be as small as 10%.

The toner of the present invention may also preferably have, in an endothermic curve as measured by a differential scanning calorimeter (DSC), a maximum endothermic peak in the range of temperature of from 30° C. to 200° C. and a peak temperature thereof in the range of from 60° C. to 130° C., more preferably in the range of from 65° C. to 125° C., and still more preferably in the range of from 65° C. to 110° C.

By the use of the resin having a polyester unit, synthesized using the titanium chelate compound according to the present as a catalyst, the state of appropriate fine dispersion of the wax in toner particles can be realized when the peak temperature of the maximum endothermic peak is in the range of from 60° C. to 130° C., which is preferable in order to bring out the effect of the present invention. Meanwhile, if the peak temperature of the maximum endothermic peak is less than 60° C., the toner may have poor anti-offset properties. If on the other hand the peak temperature of the maximum endothermic peak is more than 130° C., the toner tends to be inferior in fixing performance.

The wax may be used in an amount of from 0.1 to 20 parts by weight, and preferably from 0.5 to 10 parts by weight, based on 100 parts by weight of the binder resin.

The toner of the present invention may further preferably have, in molecular weight distribution of its resin component as measured by gel permeation chromatography (GPC), a main peak in the molecular weight region of from 3,500 to 15,000, and more preferably in the molecular weight region of from 4,000 to 13,000. The ratio of weight-average molecular weight (Mw) to number-average molecular weight (Mn), Mw/Mn, is preferably 3.0 or more, and more preferably 5.0 or more. If the toner has a main peak in the molecular weight region of less than 3,500, the toner may have insufficient high-temperature anti-offset properties. If on the other hand it has a main peak in the molecular weight region of more than 15,000, the toner may have no sufficient low-temperature fixing performance and also may have low OHP transparency. If the Mw/Mn is less than 3.0, good anti-offset properties cannot be realized.

As the colorant used in the toner of the present invention, any known dyes and/or pigments may be used. A pigment may be used alone, but in view of image quality of full-color images, it is more preferable to use a dye and a pigment in combination so that the color sharpness can be improved. Examples of dyes and pigments used as the colorant are given below.

As pigments for magenta toner, they may include condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, they may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 254, C.I. Pigment Violet 19, and C.I. Vat Red 1, 2, 10, 13, 15, 23, 29, 35.

As dyes for magenta toner, they may include oil-soluble dyes such as C.I. Solvent Red 1, 3, 8, 23, 24, 25, 27, 30, 4.9, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As pigments for cyan toner, they may include C.I. Pigment Blue 1, 2, 3, 7, 15:1, 15:2, 15:3, 15:4, 16, 17; 60, 62, 66; and C.I. Vat Blue 6, C.I. Acid Blue 45, or copper phthalocyanine pigments whose phthalocyanine skeleton has been substituted with 1 to 5 phthalimide methyl group(s), having a structure represented by the following formula:

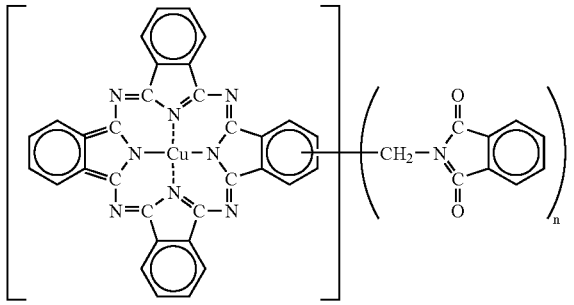

wherein n represents an integer of 1 to 5.

As pigments of yellow toner, they may include condensation azo compounds, isoindolinone compounds, anthraquinone compounds, azo metal complexes, methine compounds and allylamide compounds. Stated specifically, they are C.I. Pigment Yellow 1, 2, 3, 4, 5, 6, 7, 10, 11, 12, 13, 14, 15, 16, 0.17, 23, 62, 65, 73, 74, 83, 93, 95, 97, 109, 110, 111, 120, 127, 128, 129, 147, 155, 168, 174, 180, 181, 191, and C.I. Vat Yellow 1, 3, 20. Also usable are dyes such as C.I. Direct Green 6, C.I. Basic Green 4, C.I. Basic Green 6 and C.I. Solvent Yellow 162.

As black colorants used in the present invention, usable are carbon black, iron oxides, and colorants toned in black by mixing the yellow, magenta and cyan colorants shown above.

In the toner of the present invention, it is preferable to use one in which the colorant is beforehand mixed in a portion of the binder resin of the present invention to make them into a master batch. Then, this colorant master batch, the remaining resin and other materials such as the wax are melt-kneaded, whereby the colorant can well be dispersed in toner particles.

Where the resin according to the present invention is used and the colorant is made into the master batch, the dispersibility of colorant does not deteriorate even when the colorant is used in a large quantity, and also the dispersibility of colorant in toner particles is improved to bring about superior color reproducibility such as color mixing performance or transparency. Also, a toner having a large covering power on the transfer material can be obtained. Still also, since the dispersibility of colorant is improved, the toner can have superior running stability of chargeability to form images having maintained high image quality.

In the toner, the colorant may be used in an amount of from 0.1 to 15 parts by weight, more preferably from 0.5 to 12 parts by weight, and still more preferably from 2 to 10 parts by weight, based on 100 parts by weight of the binder resin. The use of the colorant in such a quantity is preferable in view of color reproducibility and developing performance.

A known charge control agent may be used in the toner of the present invention in order to make the chargeability stable. Usually, the charge control agent may preferably be contained in toner particles in an amount of from 0.1 to 10 parts by weight, and more preferably from 0.1 to 5 parts by weight, which may differ depending on the type of the charge control agent or the physical properties of toner particle constituent materials. Such a charge control agent is known to include one capable of controlling the toner to be negatively chargeable and one capable of controlling the toner to be positively chargeable. One or more types of various charge control agents may be used according to types and uses of toner.

As negative charge control agents, usable are salicylic acid metal compounds, naphthoic acid metal compounds, dicarboxylic acid metal compounds, polymer type compounds having sulfonic acid or carboxylic acid in the side chain, boron compounds, urea compounds, silicon compounds, and carixarene. As positive charge control agents, usable are quaternary ammonium salts, polymer type compounds having such a quaternary ammonium salt in the side chain, guanidine compounds, and imidazole compounds. The charge control agent may internally be added, or may externally be added, to the toner particles.

Where the toner of the present invention is used, it is preferable for the toner to contain an aromatic carboxylic acid metal compound. The aromatic carboxylic acid metal compound is preferable because it is colorless, can quickly charge the toner and can stably maintain a constant charge quantity.

The toner of the present invention is characterized by having at least inorganic fine particles. Also, it is preferable for the inorganic fine particles to be at least one of fine titanium oxide particles and fine silica particles.

The fine titanium oxide particles used in the present invention may include sulfuric acid process titanium compounds, chlorine process titanium compounds and volatile titanium compounds, as exemplified by fine titanium oxide particles produced by low-temperature oxidation (such as thermal decomposition or hydrolysis) of titanium alkoxides, titanium halides or acetylacetonatotitanium.

Crystal forms of the fine titanium oxide particles may be anatase type, rutile type, mixed-crystal form of these, or amorphous, any of which may be used.

The present inventors have discovered that, in the toner of the present invention which makes use of the resin having a polyester unit, synthesized using the titanium chelate compound, the incorporation of the fine titanium oxide particles is very effective in achieving charge stability during running (extensive operation), in particular, charge stability in a low-humidity environment. The reason therefor is that, when the toner of the present invention which makes use of the resin having a polyester unit, synthesized using the titanium chelate compound, is incorporated with the fine titanium oxide particles, the fine titanium oxide particles show substantially neutral chargeability, and hence they bring about the effect of restraining charge-up especially in a low-humidity environment.

The toner of the present invention may also preferably be incorporated with fine silica particles in view of charge quantity control.

Fine silica particles used preferably in the present invention include the so-called dry-process silica or fumed silica produced by vapor phase oxidation of silicon halides and the so-called wet-process silica produced from water glass. The dry-process silica is preferred, as having less silanol groups on the surfaces and insides of the fine silica particles and leaving less production residues such as $Na_2O$ and $SO_3^{2-}$. In the dry-process silica, it is also possible to use, in its production step, other metal halide compounds such as aluminum chloride or titanium chloride together with the silicon halide to give composite fine powder of silica with other metal oxides. The fine silica particles include these as well.

The so-called dry-process silica or fumed silica is produced by a conventionally known technique. For example, it is a process that utilizes heat decomposition oxidation reaction in oxyhydrogen frame of silicon tetrachloride gas. The reaction basically proceeds as follows.

$$SiCl_4+2H_2+O_2 \rightarrow SiO_2+4HCl$$

These fine titanium oxide particles and fine silica particles may preferably be those having been made hydrophobic with a hydrophobic-treating agent such as a silane compound, a silicone oil or a mixture of these.

The hydrophobic-treating agent may include coupling agents such as a silane coupling agent, a titanate coupling agent, an aluminum coupling agent and a zircoaluminate coupling agent.

Stated specifically, the silane coupling agent may preferably be a compound represented by the following general formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative thereof; and n represents an integer of 1 to 3.

Such a compound may include, e.g., hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

In the treatment, the silane coupling agent may preferably be used in an amount of from 1 to 60 parts by weight, and more preferably from 3 to 50 parts by weight, based on 100 parts by weight of the inorganic fine particles.

Particularly preferred in the present invention is an alkylalkoxysilane compound represented by the general formula:

$$C_nH_{2n+1}—Si—(OC_mH_{2m+1})_3$$

wherein n represents an integer of 4 to 12, and m represents an integer of 1 to 3.

In the alkylalkoxysilane compound, if n is larger than 12, though hydrophobicity can be sufficient, inorganic fine particles may greatly coalesce one another to tend to have low fluidity-providing ability. If m is larger than 3, the alkylalkoxysilane compound may have low reactivity and is unable to make the inorganic fine particles sufficiently hydrophobic. In the alkylalkoxysilane compound, n is preferably from 1 to 8, and m is preferably 1 or 2.

In the treatment with the alkylalkoxysilane compound, the compound may be used in an amount of from 1 to 60 parts by weight, and preferably from 3 to 50 parts by weight, based on 100 parts by weight of the inorganic fine particles.

The hydrophobic treatment may be carried out using one kind of hydrophobic-treating agent alone, or using two or more kinds of hydrophobic-treating agents. For example, the hydrophobic treatment may be made using one kind of hydrophobic-treating agent alone or using two kinds of hydrophobic-treating agents together, or may made by using one hydrophobic-treating agent and thereafter using another hydrophobic-treating agent.

The fine titanium oxide particles and/or the fine silica particles may preferably be added in an amount of from 0.01 to 5 parts by weight, and preferably from 0.05 to 3 parts by weight, based on 100 parts by weight of the toner particles.

Further, the toner according to the present invention may be constituted as either a non-magnetic toner or a magnetic toner.

The toner of the present invention may be used in either of one-component developers and two-component developers. When used in the two-component developers, the toner is used in the form of a blend with a carrier. As the carrier, usable are known carriers such as magnetic-material particles per se, a coated carrier comprising magnetic-material particles coated with a resin, and a magnetic-material-dispersed resin carrier comprising magnetic-material particles dispersed in resin particles. As the magnetic-material particles, usable are, e.g., particles of metals such as iron, lithium, calcium, magnesium, nickel, copper, zinc, cobalt, manganese, chromium and rare earth elements, which may be surface-oxidized or non-oxidized, and alloys or oxide particles of any of these, and ferrite particles.

The coated carrier comprising carrier particles surface-coated with a resin is particularly preferred in developing methods in which an AC bias is applied to a developing sleeve. Methods for coating the carrier particle surfaces may include a method in which a coating fluid prepared by dissolving or suspending a coating material such as a resin in a solvent is applied to the surfaces of magnetic carrier core particles, and a method in which the magnetic carrier core particles and the coating material are mixed in the form of powder.

The coating material applied on the surfaces of magnetic carrier core particles may include silicone resins, polyester resins, styrene resins, acrylic resins, polyamide, polyvinyl butyral, aminoacrylate resins and fluorine resins. Any of these may be used alone or in combination. In the treatment with the coating material, the coating material may preferably be used in an amount of from 0.1% by weight to 30% by weight, and more preferably from 0.5 to 20% by weight, based on the weight of the carrier core particles. Such magnetic carrier core particles may have a number-average particle diameter of from 10 μm to 100 μm, and more preferably from 20 μm to 70 μm.

The number-average particle diameter of the magnetic carrier core particles can be determined as follows: at least 300 carrier particles of 0.1 μm or more in diameter are picked out at random with a scanning electron microscope (100 to 5,000 magnifications), and their horizontal-direction Fere's diameters are measured as carrier particle diameters by means of a digitizer to calculate therefrom the number-average particle diameter of the carrier core particles.

When the two-component developer is prepared by blending the toner of the present invention and the magnetic carrier, they may preferably be blended in a proportion of from 2% by weight to 15% by weight, and more preferably from 4% by weight to 13% by weight, as toner concentration in the developer in order to obtain good images. If the toner concentration is less than 2% by weight, image density tends to lower. If it is more than 15% by weight, fog or in-machine toner scatter tends to occur.

The procedure of producing the toner is described below. The toner of the present invention may be produced by mixing the binder resin, the colorant, the wax and any desired materials, melt-kneading the mixture obtained, and cooling and pulverizing the kneaded product, optionally followed by spherical treatment or classification of the pulverized product, and further optionally followed by mixing a fluidity-providing agent with the resultant product.

In the step of mixing the raw materials, at least the resin and the colorant are weighed and compounded as toner internal additives in stated quantities, and mixed. As examples of a mixer therefor, it includes Doublecon Mixer, a V-type mixer, a drum type mixer, Super mixer, Henschel mixer and Nauta mixer.

Further, the toner raw materials compounded and mixed in the above step are melt-kneaded to melt resins and the colorant is dispersed therein. Batch type kneaders such as a pressure kneader and Banbury mixer, or continuous-type kneaders may be used in that melt-kneading step. In recent years, single-screw or twin-screw extruders are prevailing because of an advantage of continuous production. For example, the following are commonly used: a KTK-type extruder manufactured by Kobe Steel, Ltd., a TEM-type mixer manufactured by Toshiba Machine Co., Ltd.), a twin-screw extruder manufactured by KCK Co., and a co-kneader manufactured by Coperion Buss Ag. A colored resin composition obtained by melt-kneading the toner raw materials is further melt-kneaded, and thereafter rolled out by means of a twin-roll mill or the like, followed by cooling through a cooling step where the kneaded colored resin composition is cooled.

Then, in general, the cooled product of the colored resin composition thus obtained is subsequently pulverized in a pulverization step into a product having the desired particle diameter. In the pulverization step, the cooled colored resin composition is first crushed by means of a grinding machine such as a crusher, a hammer mill or a feather mill, and is further pulverized by means of a pulverizer such as a Criptron system manufactured by Kawasaki Heavy Industries, Ltd. or a super rotor manufactured by Nisshin Engineering Inc. Thereafter, the pulverized product obtained is optionally classified using a sifting machine, e.g., a classifier such as Elbow Jet (manufactured by Nittetsu Mining Co., Ltd.), which is of an inertial classification system, or Turboplex (manufactured by Hosokawa Micron Corporation), which is of a centrifugal classification system, obtaining a classified product with a weight-average particle diameter of from 3 μm to 11 μm.

The classified product may optionally be subjected to surface modification and spherical treatment by means of a hybridization system manufactured by Nara Machinery Co., Ltd. or a mechanofusion system manufactured by Hosokawa Micron Corporation. In such a case, a sifting machine such as an air sifter High Bolter (manufactured by Shin Tokyo Kikai K. K.). As a method for external addition treatment with an external additive such as inorganic fine particles, a method is available in which the classified toner and known various external additives are compounded in stated quantities and then agitated and mixed using as an external addition machine a high-speed agitator which provide powder with shear force, such as the Henschel mixer or Super mixer.

Methods for measuring the values of physical properties of the toner of the present invention are as follows:

1) Light Transmittance in 45 Vol. % Methanol Aqueous Solution:

(i) Preparation of toner dispersion:

An aqueous solution is prepared in which the volume mixing ratio of methanol to water is 45:55. Then, 10 ml of this aqueous solution is put into a 30 ml sample bottle (SV-30, available from Nichiden-Rika Glass Co., Ltd.), and 20 g of the toner is soaked therein at the liquid surface, and the bottle is closed. Thereafter, this bottle is shaked at 2.5 $S^{-1}$ for 5 seconds by means of a Yayoi shaker. Here, the angle of shaking is so set that the support of shaking moves forward by 15 degrees and backward by 20 degrees regarding the just above position (vertical) as 0 degree. The sample bottle is fastened to a fastening holder attached to the end of the support (the cover of the sample bottle is fixed on the extension of the center of the support). A liquid dispersion at the time the sample bottle is taken out and 30 seconds have passed is used for measurement.

(ii) The liquid dispersion obtained in the step (i) is put in a 1 cm square quartz cell, and the transmittance (%) of light of 600 nm in the liquid dispersion after 10 minutes is measured with a spectrophotometer MPS2000 (manufactured by Shimadzu Corporation).

$$\text{Light transmittance (\%)} = I/I_0 \times 100$$

where I represents transmitted-light flux, and $I_0$ represents incident-light flux.

2) Measurement of Peak Temperature of Maximum Endothermic Peak in Toner and Wax:

Temperature curve:

Heating I (30° C. to 200° C.; heating rate: 10° C./min).

Cooling I (200° C. to 30° C.; Cooling rate: 10° C./min).

Heating II (30° C. to 200° C.; heating rate: 10° C./min)

The maximum endothermic peak of the toner and wax is measured with a differential scanning calorimeter (DSC measuring instrument) DSC-7 (manufactured by Perkin-Elmer Corporation) or DSC2920 (manufactured by TA Instruments Japan Ltd.). Measurement is carried out according to ASTM D3418-82.

A sample for measurement is precisely weighed in an amount of from 2 to 20 mg, preferably 10 mg. This sample is put in an aluminum pan and an empty aluminum pan is used as reference. Measurement is made in a normal-temperature and normal-humidity environment (23° C./50% RH) at a heating rate of 10° C./min within the measuring temperature range of from 30° C. to 200° C. The maximum endothermic peak of the toner and wax is regarded as the following: in the course of Heating II, a peak which is highest from the base line in a region not lower than the endothermic peak at the glass transition temperature (Tg) of the resin in the course of Heating II, or, when the endothermic peak at the glass transition temperature (Tg) of the resin overlaps with other endothermic peaks and is difficult to distinguish, a peak which is highest among the peaks overlapping.

3) Measurement of Molecular Weight by Gel Permeation Chromatography (GPC):

The measurement of molecular weight of the binder resin by gel permeation chromatography (GPC) is carried out under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a sample THF solution of resin adjusted to have a sample concentration of form 0.05 to 0.6% by weight is injected thereinto to make measurement. In measuring the molecular weight of the sample, the molecular weight distribution of the sample is calculated from the relationship between the logarithmic value of a calibration curve prepared using several kinds of monodisperse polystyrene standard samples and the count number (retention time). As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Tosoh Corporation or Pressure Chemical Co., and to use at least about 10 standard polystyrene samples. An RI (refractive index) detector is used as a detector.

As columns, in order to make precise measurement in the region of molecular weight of from 1,000 to 2,000,000, it is desirable to use a plurality of commercially available polystyrene gel columns in combination. For example, they may preferably comprise a combination of Shodex GPC KF-801, KF-802, KF-803, KF-804, KF-805, KF-806 and KF-807, available from Showa Denko K.K., and β-Styragel 500, 1,000, 10,000 and 100,000, available from Waters Co.

4) Measurement of Particle Size Distribution of Toner:

In the present invention, the average particle diameter and particle size distribution of the toner are measured with a Coulter counter Model TA-II (manufactured by Coulter Electronics, Inc.). Coulter Multisizer (manufactured by Coulter Electronics, Inc.) may also be used. As an electrolytic solution, a 1% NaCl aqueous solution is prepared using first-grade sodium chloride. For example, ISOTON R-II (available from Coulter Scientific Japan Co.) may be used. Measurement is carried out by adding as a dispersant 0.1 to 5 ml of a surface active agent, preferably an alkylbenzenesulfonate, to 100 to 150 ml of the above aqueous electrolytic solution, and further adding 2 to 20 mg of a sample for measurement. The electrolytic solution with the sample suspended therein is subjected to dispersion for about 1 minute to about 3 minutes in an ultrasonic dispersion machine. The volume distribution and number distribution of the toner are calculated by measuring the volume and number of toner particles of 2.00 μm or larger diameters by means of the above measuring instrument, using an aperture of 100 μm. Then the weight-based, weight average particle diameter (D4) (the median of each channel is used as the representative value for each channel) according to the present invention is determined by calculation from the volume distribution.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

5) Measurement of Acid Value of Resin:

Basic operation is carried out according to JIS K-0070.

(1) A crushed product of a sample is precisely weighed in an amount of from 0.5 to 2.0 g, and the weight of the sample is represented by W (g).
(2) The sample is put in a 300 ml beaker, and 150 ml of a toluene/ethanol (4/1) mixed solvent is added thereto to dissolve the sample.
(3) Using an ethanol solution of 0.1 mol/l of KOH, titration is carried out by means of a potentiometric titrator. (For example, automatic titration may be utilized which is made using a potentiometric titrator AT-400, WIN WORKSTATION, and an ABP-410 motor burette, manufactured by Kyoto Electronics Manufacturing Co., Ltd.)
(4) The amount of the KOH solution used here is represented by S (ml). A blank is measured at the same time, and the amount of the KOH solution used in the blank is represented by B (ml).
(5) The acid value is calculated according to the following expression. Letter symbol f is the factor of KOH.

$$\text{Acid value (mg·KOH/g)}=\{(S-B)\times f\times 5.61\}/W.$$

6) Glass Transition Temperature of Resin:

The glass transition temperature (Tg) of the resin is measured according to ASTM D3418-82, using a differential scanning calorimeter (DSC measuring instrument) DSC-7 (manufactured by Perkin-Elmer Corporation) or DSC2920 (manufactured by TA Instruments Japan Ltd.).

A sample for measurement is precisely weighed in an amount of 5 to 20 mg, and preferably 10 mg. This sample is put in an aluminum pan and an empty aluminum pan is used as reference. Measurement is made in a normal-temperature and normal-humidity environment (25° C./60% RH) at a heating rate of 10° C./min within the measurement range of from 30° C. to 200° C. In the course of this heating, a change in specific heat are obtained within the range of temperature of from 40° C. to 100° C. The point at which the middle-point line between the base lines of a differential thermal curve before and after the appearance of the change in specific heat intersects with the differential thermal curve intersect is regarded as the glass transition point (Tg).

7) Measurement of Softening Point of Resin:

The softening point-can be measured with a fall-type flow tester according to JIS K 7210. A specific measuring method is shown below. Using a fall-type flow tester manufactured by Shimadzu Corporation, 1 $cm^3$ of a sample is heated at a heating rate of 6° C./min, during which a load of 1,960 N/m (20 $kg/cm^2$) is applied by means of a plunger, and a nozzle of 1 mm in diameter and 1 mm in length is so set as to be pushed out, whereby a plunger fall level (flow value)—temperature curve is drawn. Where the height of the sigmoid (S-shaped) curve is represented by h, the temperature corresponding to h/2 (temperature at which a half of the resin has flowed out) is regarded as the softening point (Tm) of the resin.

8) Measurement of Average Circularity of Toner:

In the present invention, the toner may preferably have an average circularity of from 0.930 to 0.990, and more preferably from 0.930 to 0.975, as measured by a flow type particle image analyzer.

The average circularity of the toner is measured by a flow type particle image analyzer "FPIA-2100 Model" (manufactured by Sysmex Corporation), and is calculated using the following expressions.

$$\text{Circle-corresponding diameter}=(\text{particle projected area}/\pi)^{1/2}\times 2$$

$$\text{Circularity}=\frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.000 when the toner particles are perfectly spherical. The more complicate the surface shape is, the smaller the value of circularity is.

Average circularity C which means an average value of circularity frequency distribution is calculated from the following expression where the circularity at a partition point i of particle size distribution (a central value) is represented by ci, and the number of particles measured by m.

$$\text{Average circularity } C=\sum_{i=1}^{m} ci/m.$$

In addition, the measuring instrument FPIA-2100 used in the present invention calculates the circularity of each particle and thereafter calculates the average circularity, where, according to circularities obtained, particles are divided into classes in which circularities of from 0.4 to 1.0 are equally divided at intervals of 0.01, and the average circularity is calculated using the divided-point center values and the number of particles measured.

Referring to a specific way of measurement, 10 ml of ion-exchanged water from which impurity solid matter or the like has been removed is made ready in a container, and a surface active agent, preferably alkylbenzenesulfonate, is added thereto as a dispersant. Thereafter, a sample for measurement is further added in an amount of 0.02 g, and is uniformly dispersed. As a means for dispersing it, an ultrasonic dispersion mixer "TETORAL 50 Model" (manufactured by Nikkaki Bios Co.) is used, and dispersion treatment is carried out for 2 minutes to prepare a liquid dispersion for measurement, where the liquid dispersion is appropriately cooled so that its temperature does not come to 40° C. or more. Also, in order to keep the circularity from scattering, the flow type particle analyzer FPIA-2100 is installed in an environment controlled to 23° C.±0.5° C. so that its in-machine temperature can be kept at 26 to 27° C., and autofocus adjustment is performed using 2 μm latex particles at intervals of constant time, and preferably at intervals of 2 hours.

In measuring the circularity of the toner, the above flow type particle analyzer is used and the concentration of the liquid dispersion is again so controlled that the toner concentration at the time of measurement is 3,000 to 10,000 particles/μl, where 1,000 or more toner particles are measured. After the measurement, using the data obtained, the data of particles with a circle-corresponding diameter of less than 2 μm are cut, and the average circularity of the toner is determined.

As compared with "FPIA-1000" used conventionally to calculate the shape of toner particles, the measuring instrument "FPIA-2100" used in the present invention has been improved in precision of measurement of toner particle shapes because of an improvement in magnification of processed particle images and also an improvement in processing resolution of images captured (from 256×256 to 512×512), and therefore having achieved surer capture of finer particles. Accordingly, where the particle shapes must be more accurately measured as in the present invention, FPIA-2100 is more useful.

Where the toner has an average circularity of from 0.930 to 0.990, deterioration in the external additives such as inorganic fine particles may be reduced, and good images can also be obtained in running (extensive operation).

If the toner has an average circularity of less than 0.930, the external additives such as inorganic fine particles may greatly deteriorate, and good images may be difficult to obtain in running (extensive operation). If on the other hand the toner has an average circularity of more than 0.990, the spherical treatment must be carried out in excess to obtain such a toner, and the heat generated in such treatment may exude onto toner particle surfaces in excess to tend to contaminate members coming into contact with the toner.

An example of the image forming method of the present invention is more specifically described below with reference to FIG. 3.

Figure 3:
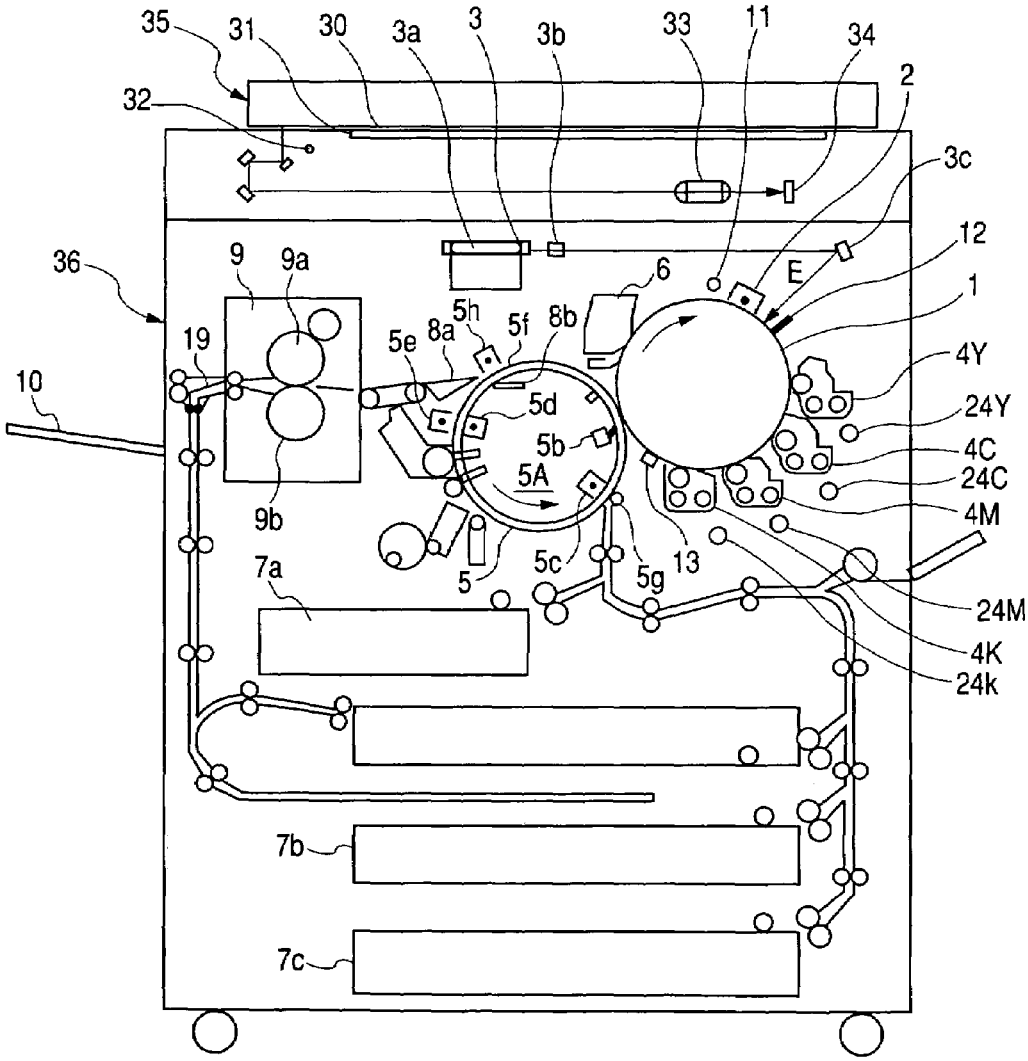
FIG. 3 schematically illustrates an example of an image forming apparatus used in the image forming method of the present invention.

FIG. 3 schematically illustrates the constitution of an example of an image forming apparatus which can practice the image forming method of the present invention.

This image forming apparatus is set up as a full-color copying machine. The full-color copying machine has, as shown in FIG. 3, a digital color-image reader section 35 at the top and a digital color-image printer section 36 at the lower part.

In the image reader section, an original 30 is placed on an original-setting glass 31, and an exposure lamp 32 is put into exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the image printer section 36, a photosensitive drum 1 as an image bearing member is a photosensitive member formed of, e.g., an organic photoconductor, and is supported rotatably in the direction of an arrow. Around the photosensitive drum 1, a pre-exposure lamp 11, a corona charging assembly 2 as a primary charging assembly, a laser exposure optical system 3 as a latent image forming means, a potential sensor 12, four different-color developing assemblies 4Y, 4C, 4M and 4K, a detecting means 13 for detecting the amount of light on the drum, a transfer assembly 5A as a transfer means and a cleaner 6 are provided.

In the laser exposure optical system 3, the image signals sent from the reader section 35 are converted into optical signals for image scanning exposure in a laser output section (not shown). The laser light thus converted is reflected on a polygonal mirror 3*a* and projected on the surface of the photosensitive drum 1 through a lens 3*b* and a mirror 3*c*.

In the printer section 36, the photosensitive drum 1 is rotated in the direction of an arrow at the time of image formation. The photosensitive drum 1 is, after destaticized by the pre-exposure lamp 11, uniformly negatively charged by means of the charging assembly 2, and then irradiated with an optical image E for each separated color to form a latent image on the photosensitive drum 1.

Next, a stated developing assembly is operated to develop the latent image formed on the photosensitive drum 1 to form on the photosensitive drum 1 a visible image formed of a negatively chargeable toner composed basically of resin, i.e., a toner image. The developing assemblies 4Y, 4C, 4M and 4K are alternately come close to the photosensitive drum 1 in accordance with the respective separated colors by the operation of eccentric cams 24Y, 24C, 24M and 24K, respectively, to perform development.

The transfer assembly 5A has a transfer drum 5, a transfer charging assembly 5*b*, an attraction charging assembly 5*c* for attracting a recording material electrostatically, and an attraction roller 5*g* provided opposite to the assembly 5*c*, an inside charging assembly 5*d*, an outside charging assembly 5*e* and a separation charging assembly 5*h*. The transfer drum 5 is supported on a shaft so that it can be rotatably driven, and has a transfer sheet 5*f* serving as a recording material holding member that holds the recording material (transfer material) at an open zone on the periphery thereof; the transfer sheet 5*f* being provided on a cylinder under integral adjustment. As the transfer sheet 5*f*, polycarbonate film or the like is used.

The recording material is transported from a cassette 7*a*, 7*b* or 7*c* to the transfer drum 5 through a transfer sheet transport system, and is held on the transfer sheet 5*f*. Following the rotation of the transfer drum 5, the recording material held on the transfer drum 5 is repeatedly transported to the transfer position facing the photosensitive drum 1. While it passes the transfer position, the toner image formed on the photosensitive drum 1 is transferred to the recording material by the action of the transfer charging assembly 5*b*.

The above steps of image formation are repeatedly carried out for yellow (Y), magenta (M), cyan (C) and black (K), thus a color toner image formed by transferring and superimposing four-color toner images is obtained on the recording material held on the transfer drum 5.

In the case of one-side image formation, the recording material to which the four-color toner images have been thus transferred is separated from the transfer drum 5 by the action of a separation claw 8*a*, a separation push-up roller 8*b* and the separation charging assembly 5*h*, and conveyed to a heat fixing assembly 9 serving as a fixing means. This heat fixing assembly 9 is constituted of a heat fixing roller 9*a* having a heating means internally and a pressure roller 9*b*. The recording material passes through the pressure contact zone between the heat fixing roller 9*a* as a heating member and the pressure roller 9*b*. Thus, the full-color toner image supported on the recording material is fixed to the recording material. That is, by this fixing step the color mixing of the toners, color formation, and fixing to the recording material are performed until a full-color permanent image is formed.

Thereafter, the recording material having the image thus formed is discharged to a tray 10. Thus, the full-color copying on one sheet is completed. Meanwhile, the photosensitive drum 1 is cleaned by the cleaner 6 so that toners remaining on its surface are removed, and thereafter again put to the steps of image formation.

EXAMPLES

The present invention is described below by giving specific working examples. The present invention is by no means limited to these examples.

Resin Having Polyester Unit

Production Example 1

As polyester unit components, 3.6 moles of polyoxypropylene(2.2)-2,2-bis(4-hydroxyphenyl)propane, 1.6 moles of polyoxyethylene(2.2)-2,2-bis(4-hydroxyphenyl)propane, 1.8 moles of terephthalic acid, 2.5 moles of dodecenylsuccinic acid, 0.5 moles of trimellitic anhydride and 3.0 g of a titanium chelate (Exemplary Compound 3) were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 245° C. for 5 hours to obtain Resin 1 Having Polyester Unit. The polyester unit components in the resin having a polyester unit are in a proportion of 100% by weight with respect to the resin having a polyester unit. Physical properties of Resin 1 Having Polyester Unit are shown in Table 1.

Resin Having Polyester Unit

Production Example 2

As components constituting a vinyl polymer unit (hereinafter referred to also as "vinyl polymer unit components"), 1.1 moles of styrene, 0.14 moles of 1,2-ethylhexyl acrylate, 0.1 moles of acrylic acid and 0.05 moles of dicumyl peroxide were put into a dropping funnel. In addition, as polyester unit components, 2.0 moles of polyoxypropylene(2.2)-2,2-bis(4-hydroxyphenyl)propane, 0.8 moles of polyoxyethylene(2.2)-2,2-bis(4-hydroxyphenyl)propane, 0.8 moles of terephthalic acid, 0.6 moles of trimellitic anhydride, 1.5 moles of fumaric acid and 2.7 g of a titanium chelate (Exemplary Compound 3) were put into a 4-liter four-necked flask made of glass, and a thermometer, a stirring rod, a condenser and a nitrogen feed tube were attached thereto. This was placed in a mantle heater.

Next, the inside of the flask was displaced with nitrogen gas, followed by gradual heating with stirring. With stirring at a temperature of 145° C., the monomers, cross-linking agent and polymerization initiator for the vinyl resin were dropwise added thereto over a period of 4 hours. Subsequently, the mixture was heated to 245° C. to carry out reaction for 4 hours to obtain Resin 2 Having Polyester Unit. The polyester unit components in the resin having a polyester unit are in a proportion of 90% by weight with respect to the resin having a polyester unit. Physical properties of Resin 2 Having Polyester Unit are shown in Table 1.

Resin Having Polyester Unit

Production Example 3

As polyester unit components, 5.2 moles of polyoxypropylene(2.2)-2,2-bis(4-hydroxyphenyl)propane, 1.8 moles of terephthalic acid, 2.5 moles of dodecenylsuccinic acid, 0.5 moles of trimellitic anhydride, 0.7 g of a titanium chelate (Exemplary Compound 1) and 2.0 g of a titanium chelate (Exemplary Compound 3) were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 245° C. for 5 hours to obtain Resin 3 Having Polyester Unit. The polyester unit components in the resin having a polyester unit are in a proportion of 100% by weight with respect to the resin having a polyester unit. Physical properties of Resin 3 Having Polyester Unit are shown in Table 1.

Resin Having Polyester Unit

Production Example 4

Resin 4 Having Polyester Unit was obtained in the same manner as in Resin Having Polyester Unit Production Example 3 except that in place of the titanium chelate Exemplary Compounds 1 and 3 a titanium chelate Exemplary Compound 2 was used. The polyester unit components in the resin having a polyester unit are in a proportion of 100% by weight with respect to the resin having a polyester unit. Physical properties of Resin 4 Having Polyester Unit are shown in Table 1.

Resin Having Polyester Unit

Production Example 5

Resin 5 Having Polyester Unit was produced in the same manner as in Resin Having Polyester Unit Production Example 3 except that in place of the titanium chelate Exemplary Compounds 1 and 3 only the titanium chelate Exemplary Compound 1 was used. The polyester unit components in the resin having a polyester unit are in a proportion of 100% by weight with respect to the resin having a polyester unit. Physical properties of Resin 5 Having Polyester Unit are shown in Table 1.

Resin Having Polyester Unit

Production Example 6

Resin 6 Having Polyester Unit was obtained in the same manner as in Resin Having Polyester Unit Production Example 3 except that in place of the titanium chelate Exemplary Compounds 1 and 3 a titanium chelate Exemplary Compound 4 was used. The polyester unit components in the resin having a polyester unit are in a proportion of 100% by weight with respect to the resin having a polyester unit. Physical properties of Resin 6 Having Polyester Unit are shown in Table 1.

Resin Having Polyester Unit

Production Example 7

Resin 7 Having Polyester Unit was obtained in the same manner as in Resin Having Polyester Unit Production Example 3 except that in place of the titanium chelate Exemplary Compounds 1 and 3 tetramethyl titanate was used. The polyester unit components in the resin having a polyester unit are in a proportion of 100% by weight with respect to the resin having a polyester unit. Physical properties of Resin 7 Having Polyester Unit are shown in Table 1.

Resin Having Polyester Unit

Production Example 8

Resin 8 Having Polyester Unit was obtained in the same manner as in Resin Having Polyester Unit Production Example 3 except that in place of the titanium chelate Exemplary Compounds 1 and 3 dioctyltin oxide was used. The polyester unit components in the resin having a polyester unit are in a proportion of 100% by weight with respect to the resin having a polyester unit. Physical properties of Resin 8 Having Polyester Unit are shown in Table 1.

Resin Having Polyester Unit

Production Example 9

As vinyl polymer unit components, 1.1 moles of styrene, 0.16 moles of butyl acrylate, 0.1 mol of acrylic acid and 0.05 mol of dicumyl peroxide were put into a dropping funnel. Also, as polyester unit components, 1.4 moles of polyoxypropylene(2.2)-2,2-bis(4-hydroxyphenyl)propane, 1.4 moles of polyoxyethylene(2.2)-2,2-bis(4-hydroxyphenyl) propane, 0.8 moles of terephthalic acid, 0.6 moles of trimellitic anhydride, 1.0 mole of fumaric acid, 3.2 g of a dihydrate of a titanium chelate Exemplary Compound 11 and 0.1 g of magnesium carbonate were put into a 4-liter four-necked flask made of glass, and a thermometer, a stirring rod, a condenser and a nitrogen feed tube were attached thereto. This was placed in a mantle heater.

Next, the inside of the flask was replaced with nitrogen gas, followed by gradual heating with stirring. With stirring at a temperature of 145° C., the monomers, cross-linking agent and polymerization initiator for the vinyl resin were added drop by drop over a period of 4 hours. Subsequently, the mixture was heated to 245° C. to carry out reaction for 4 hours to produce Resin 9 Having Polyester Unit. The polyester unit components in the resin having a polyester unit are in a proportion of 90% by weight with respect to the resin having a polyester unit. Physical properties of Resin 9 Having Polyester Unit are shown in Table 1.

Resin Having Polyester Unit

Production Example 10

Resin 10 Having Polyester Unit was obtained in the same manner as in Resin Having Polyester Unit Production Example 9 except that in place of the dihydrate of the titanium chelate Exemplary Compound 11 a dihydrate of a titanium chelate Exemplary Compound 15 was used. The polyester unit components in the resin having a polyester unit are in a proportion of 90% by weight with respect to the resin having a polyester unit. Physical properties of Resin 10 Having Polyester Unit are shown in Table 1.

Resin Having Polyester Unit

Production Example 11

Resin 11 Having Polyester Unit was obtained in the same manner as in Resin Having Polyester Unit Production Example 9 except that in place of the dihydrate of the titanium chelate Exemplary Compound 11 a dihydrate of a titanium chelate Exemplary Compound 16 was used. The polyester unit components in the resin having a polyester unit are in a proportion of 90% by weight with respect to the resin having a polyester unit. Physical properties of Resin 11 Having Polyester Unit are shown in Table 1.

Resin Having Vinyl Unit

Production Example 1

| | (by weight) |
|---|---|
| Styrene | 78.9 parts |
| n-Butyl acrylate | 19.7 parts |
| Monobutyl maleate | 1.4 parts |
| Di-tert-butyl peroxide | 1.0 part |
| Titanium chelate Exemplary Compound 1 | 1.0 part |

The above materials were added drop by drop to 200 parts by weight of xylene over a period of 4 hours. Further, polymerization was completed under reflux of xylene, and the solvent was distilled away under reduced pressure. The resin thus produced was designated as Resin 1 Having Vinyl Unit. The polyester unit components in the resin having a vinyl unit are in a proportion of 0% by weight with respect to the resin having a vinyl unit. Physical properties of Resin 1 Having Vinyl Unit are shown in Table 1.

Resin Having Polyester Unit

Production Example 12

Resin 12 Having Polyester Unit was produced in the same manner as in Resin Having Polyester Unit Production Example 3 except that in place of the titanium chelate Exemplary Compounds 1 and 3 a titanate of bisphenol-A EO (ethylene oxide) addition product was used. The polyester unit components in the resin having a polyester unit are in a proportion of 100% by weight with respect to the resin having a polyester unit. Physical properties of Resin 12 Having Polyester Unit are shown in Table 1.

Example 1

Yellow Toner 1 was Prepared in the Following Way.

First kneading step:

(by weight)

Binder resin: Resin 1 Having Polyester Unit 50 parts Pasty pigment with 50% by weight of solid content, obtained by removing water to a certain extent from a pigment slurry containing C.I. Pigment Yellow 74, without having passed through any drying steps at all (remaining 50% by weight: water) 100 parts The above raw materials were first introduced into a kneader type mixer, and were heated with mixing under application of no pressure. At the time the resultant mixture reached a maximum temperature (which depends necessarily on the boiling point of a solvent in the paste; in this case, about 90 to 100° C.), the pigment in the aqueous phase was distributed or moved to the molten resin phase. Having made sure of this, the mixture was further melt-kneaded for 30 minutes with heating to cause the pigment in the paste to move sufficiently to the resin phase. Thereafter, the mixer was stopped, and hot water was discharged. Then the mixture was further heated to 130° C. and melt-kneaded for about 30 minutes with heating to disperse the resin, and at the same time the water was evaporated off, finishing the kneading step, followed by cooling to take out the kneaded product and obtaining a first kneaded product. This first kneaded product had a water content of about 0.5% by weight.

Second kneading step:

| | (by weight) |
|---|---|
| The above first kneaded product (content of pigment particles: 50% by weight) | 10 parts |
| Binder resin: Resin 1 Having Polyester Unit | 100 parts |
| Wax: paraffin wax (maximum endothermic peak: 75.7° C.) | 5.0 parts |
| Charge control agent: aluminum compound of 3,5-di-tert-butylsalicylic acid | 1.0 part |

Materials formulated as shown above were premixed by means of Henschel mixer, and the mixture obtained was melt-kneaded using a twin-screw extrusion kneader, setting its temperature at 150° C. The kneaded product obtained was cooled and thereafter crushed by means of a hammer mill into a crushed product of about 1 to 2 mm in diameter. Then, the crushed product was finely pulverized by means of a fine grinding mill of an air jet system into particles of about 20 μm or less in diameter. The finely pulverized product thus obtained was further classified, and the classified particles were made spherical (circularity: 0.941, as measured with FPIA-2100) using a mechanofusion system having a cooling mechanism such as a chiller unit, to produce yellow resin particles (classified product) with a weight-average particle diameter of 7.2 μm in particle size distribution. Thereafter, as inorganic fine particles, 1.0 part by weight of fine titanium oxide particles of 50 nm in primary average particle diameter surface-treated with isobutyltrimethoxysilane and 0.8 part by weight of hydrophobic silica produced by treating dry-process fine silica particles of 50 nm in primary average particle diameter (BET specific surface area: 200 $m^2/g$) with dimethyldichlorosilane, thereafter with hexamethyldisilazane and further with silicone oil were added to effect external addition and mixing to produce Yellow Toner 1. Physical properties of Yellow Toner 1 are shown in Table 2.

Yellow Toner 1 was further blended with magnetic ferrite carrier particles (number-based average particle diameter: 50 μm) surface-coated with silicone resin, which were so blended as to be in a toner concentration of 6% by weight. Thus, Two-component Yellow Developer 1 was obtained. The polyester unit components contained in the whole binder resin of the Yellow Toner 1 are in a proportion of 100% by weight with respect to the whole binder resin of the Yellow Toner 1.

—Evaluation of Running Charge Stability—

Using this Two-component Yellow Developer 1 in a modified machine of a full-color copying machine CLC-1000 (manufactured by CANON INC.), from a fixing unit of which an oil application mechanism was detached and in which the process speed was set to 150 mm/sec, 50,000-sheet running tests were conducted by copying an original with an image area percentage of 5% in a monochrome mode and in a high-temperature and high-humidity environment (H/H, 30° C./80% RH), a normal-temperature and low-humidity environment (N/L, 23° C./5% RH) and a normal-temperature and normal-humidity environment (N/N, 23° C./50% RH). In each test, the triboelectric charge quantity (mC/kg) on the sleeve was examined at the initial stage (INI) and after the 50,000-sheet running (50 K) to evaluate charge stability according to the following evaluation criteria. The results of evaluation are shown in Table 3.

A method for measuring the triboelectric charge quantity on the sleeve is described in detail with reference to FIG. 1.

FIG. 1 illustrates a device for measuring the triboelectric charge quantity of two-component developers. First, 0.5 to 1.5 g of two-component developer collected from the sleeve surface is put in a measuring container 1-2 made of a metal at the bottom of which a screen 1-1 of 30 μm in mesh opening is provided, and the container is covered with a plate 1-3 made of a metal. The total weight of the measuring container 1-2 at this point is weighed and is expressed as W1 (g). Next, in a suction device 1-4 (made of an insulating material at least at the part coming into contact with the measuring container 1-2), air is sucked from a suction opening 1-5 and an air-flow control valve 1-6 is operated to control the pressure indicated by a vacuum indicator 1-7 to be 4 kPa. In this state, suction is sufficiently carried out, preferably for about 2 minutes, to suction-remove the toner. The potential indicated by a potentiometer 1-8 at this point is expressed as V (volt). Here, reference numeral 1-9 denotes a capacitor, whose capacitance is expressed as C (μF). The total weight of the measuring container after the suction is also weighed and is expressed as W2 (g). The triboelectric charge quantity (mC/kg) of the toner is calculated as in the following expression.

$$\text{Triboelectric charge quantity (mC/kg) of two-component developer} = C \times V/(W1 - W2).$$

(Evaluation Criteria)

A: The absolute value of the difference (Δ) between the triboelectric charge quantities at the initial stage and after the 50,000-sheet running is less than 5. (Excellent)

B: The absolute value of the difference (Δ) between the triboelectric charge quantities at the initial stage and after the 50,000-sheet running is 5 to less than 10, but no problem in practical use. (Good)

C: The absolute value of the difference (Δ) between the triboelectric charge quantities at the initial stage and after the 50,000-sheet running is 10 to less than 15, which is a little problematic in charge stability, but no problem in practical use.

(Acceptable)

D: The absolute value of difference (Δ) between the triboelectric charge quantity at the initial stage and that after the 50,000-sheet running is 15 or more, which is problematic in charge stability.

(Unacceptable)

Incidentally, the absolute value of the difference (Δ) between the triboelectric charge quantities at the initial stage and after the 50,000-sheet running is found by subtracting the triboelectric charge quantity after the 50,000-sheet running from the triboelectric charge quantity at the initial stage [(initial-stage triboelectric charge quantity)−(after-50,000-sheet-running triboelectric charge quantity)].

—OHP Transparency—

To measure OHP transparency, Shimadzu Autographic Spectrophotometer UV2200 (manufactured by Shimadzu Corporation) is used to measure the transmittance at the maximum absorption wavelength:

650 nm in the case of magenta toner;

500 nm in the case of cyan toner; and 600 nm in the case of yellow toner, assuming that the transmittance of the OHP film itself is 100%.

The results of evaluation are shown in Table 3(B).

A: 85% or more.

B: 75% to less than 85%.

C: 65% to less than 75%.

D: Less than 65%.

—Evaluation of Fixing Performance—

To examine fixing temperature ranges, a fixing test was conducted using a color copying machine CLC-1000 (manufactured by CANON INC.) which was so modified that an oil application mechanism was detached from its fixing unit and the process speed was able to be set at will. The development contrast was so adjusted that the toner laid-on level on paper was 1.2 mg/cm$^2$. The unfixed images were formed on A4 paper (CLC recommended paper, SK80) in an image area percentage of 25% in a monochrome mode and in a normal-temperature and normal-humidity environment (N/N, 23° C./50% RH). Thereafter, the unfixed images were fixed raising temperature from 120° C. at intervals of 10° C. in a normal-temperature and normal-humidity environment (N/N, 23° C./50% RH). The temperature width in which neither offset nor paper winding occurred was regarded as a fixable temperature range. The evaluation results are shown in Table 3.

Example 2

Yellow Toner 2 was produced, and Two-component Yellow Developer 2 was obtained and evaluated, in the same manner as in Example 1 except that Resin 2 Having Polyester Unit was used as the binder resin, behenyl behenate (peak temperature of maximum endothermic peak: 71.4° C.) was used as the wax, TN-105 (available from Hodogaya Chemical Co., Ltd.) was used as the charge control agent and the toner particles were made spherical so as to have a circularity of 0.940. The polyester unit components contained in the whole binder resin of the above Yellow Toner 2 are in a proportion of 90% by weight with respect to the whole binder resin of the above Yellow Toner 2. Physical properties of the toner are shown in Table 2, and the evaluation results of the running charge stability, OHP transparency and fixing performance are shown in Table 3.

Example 3

Yellow Toner 3 was produced, and Two-component Yellow Developer 3 was obtained and evaluated, in the same manner as in Example 1 except that Resin 3 Having Polyester Unit was used as the binder resin, an alcohol-terminated polyethylene wax (peak temperature of maximum endothermic peak: 108.9° C.) was used as the wax and the toner particles were made spherical so as to have a circularity of 0.970. The polyester unit components contained in the whole binder resin of the above Yellow Toner 3 are in a proportion of 100% by weight with respect to the whole binder resin of the above Yellow Toner 3. Physical properties of the toner are shown in Table 2, and the evaluation results of evaluation of the running charge stability, OHP transparency and fixing performance are shown in Table 3.

Example 4

Yellow Toner 4 was produced, and Two-component Yellow Developer 4 was obtained and evaluated, in the same manner as in Example 1 except that Resin 4 Having Polyester Unit was used as the binder resin and the toner particles were made spherical so as to have a circularity of 0.952. The polyester unit components contained in the whole binder resin of the above Yellow Toner 4 are in a proportion of 100% by weight with respect to the whole binder resin of the above Yellow Toner 4. Physical properties of the toner are shown in Table 2, and the evaluation results of the running charge stability, OHP transparency and fixing performance are shown in Table 3.

Example 5

Yellow Toner 5 was produced, and Two-component Yellow Developer 5 was obtained and evaluated, in the same manner as in Example 1 except that 90 parts by weight of Resin 5 Having Polyester Unit and 10 parts by weight of Resin 1 Having Vinyl Unit were used as the binder resin and the toner particles were made spherical so as to have a circularity of 0.933. The polyester unit components contained in the whole binder resin of the above Yellow Toner 5 are in a proportion of 90% by weight with respect to the whole binder resin of the above Yellow Toner 5. Physical properties of the toner are shown in Table 2, and the evaluation results of the running charge stability, OHP transparency and fixing performance are shown in Table 3.

Example 6

Yellow Toner 6 was produced, and Two-component Yellow Developer 6 was obtained and evaluated, in the same manner as in Example 1 except that 80 parts by weight of Resin 6 Having Polyester Unit and 20 parts by weight of Resin 1 Having Vinyl Unit were used as the binder resin and the toner particles were made spherical so as to have a circularity of 0.930. The polyester unit components contained in the whole binder resin of the above Yellow Toner 6 are in a proportion of 80% by weight with respect to the whole binder resin of the above Yellow Toner 6. Physical properties of the toner are shown in Table 2, and the evaluation results of the running charge stability, OHP transparency and fixing performance are shown in Table 3.

Comparative Example 1

Yellow Toner 7 was produced, and Two-component Yellow Developer 7 was obtained and evaluated, in the same manner as in Example 6 except that 80 parts by weight of Resin 7 Having Polyester Unit and 20 parts by weight of Resin 1 Having Vinyl Unit were used as the binder resin and the toner particles were made spherical so as to have a circularity of 0.930. The polyester unit components contained in the whole binder resin of the above Yellow Toner 7 are in a proportion of 80% by weight with respect to the whole binder resin of the above Yellow Toner 7. Physical properties of the toner are shown in Table 2, and the evaluation results of the running charge stability, OHP transparency and fixing performance in Table 3.

Comparative Example 2

Yellow Toner 8 was produced, and Two-component Yellow Developer 8 was obtained and evaluated, in the same manner as in Example 6 except that 80 parts by weight of Resin 8 Having Polyester Unit and 20 parts by weight of Resin 1 Having Vinyl Unit were used as the binder resin and the toner particles were made spherical so as to have a circularity of 0.938. The polyester unit components contained in the whole binder resin of the above Yellow Toner 8 are in a proportion of 80% by weight with respect to the whole binder resin of the above Yellow Toner 8. Physical properties of the toner are shown in Table 2, and the evaluation results of the running charge stability, OHP transparency and fixing performance in Table 3.

Comparative Example 3

Yellow Toner 9 was produced, and Two-component Yellow Developer 9 was obtained and evaluated, in the same manner as in Example 6 except that 100 parts by weight of Resin 1 Having Vinyl Unit was used as the binder resin and the toner particles were made spherical so as to have a circularity of 0.940. The polyester unit components contained in the whole binder resin of the above Yellow Toner 9 are in a proportion of 100% by weight with respect to the whole binder resin of the above Yellow Toner 9. Physical properties of the toner are shown in Table 2, and the evaluation results of the running charge stability, OHP transparency and fixing performance are shown in Table 3.

Example 7

Yellow Toner 10 was produced, and Two-component Yellow Developer 10 was obtained and evaluated, in the same manner as in Example 1 except that Resin 9 Having Polyester Unit was used as the binder resin and the toner particles were made spherical so as to have a circularity of 0.940. The polyester unit components contained in the whole binder resin of the above Yellow Toner 10 are in a proportion of 90% by weight with respect to the whole binder resin of the above Yellow Toner 10. Physical properties of the toner are shown in Table 2, and the evaluation results of the running charge stability, OHP transparency and fixing performance are shown in Table 3.

Example 8

Yellow Toner 11 was produced, and Two-component Yellow Developer 11 was obtained and evaluated, in the same manner as in Example 7 except that Resin 10 Having Polyester Unit was used as the binder resin and the toner particles were made spherical so as to have a circularity of 0.939. The polyester unit components contained in the whole binder resin of the above Yellow Toner 11 are in a proportion of 90% by weight with respect to the whole binder resin of the above Yellow Toner 11. Physical properties of the toner are shown in Table 2, and the evaluation results of the running charge stability, OHP transparency and fixing performance are shown in Table 3.

Example 9

Yellow Toner 12 was produced, and Two-component Yellow Developer 12 was obtained and evaluated, in the same manner as in Example 7 except that Resin 11 Having Polyester Unit was used as the binder resin and the toner particles were made spherical so as to have a circularity of 0.938. The polyester unit components contained in the whole binder resin of the above Yellow Toner 12 are in a proportion of 90% by weight with respect to the whole binder resin of the above Yellow Toner 12. Physical properties of the toner are shown in Table 2, and the evaluation results of the running charge stability, OHP transparency and fixing performance are shown in Table 3.

Example 10

Cyan Toner 1 was produced, and Two-component Cyan Developer 1 was obtained and evaluated, in the same manner as in Example 1 except that in place of C.I. Pigment Yellow 74 C.I. Pigment Blue 15:3 was used and the toner particles were made spherical so as to have a circularity of 0.940. The polyester unit components contained in the whole binder resin of the above Cyan Toner 1 are in a proportion of 100% by weight with respect to the whole binder resin of the above Cyan Toner 1. Physical properties of the toner are shown in Table 2, and the evaluation results of the running charge stability, OHP transparency and fixing performance are shown in Table 3.

Example 11

Magenta Toner 1 was produced, and Two-component Magenta Developer 1 was obtained and evaluated, in the same manner as in Example 1 except that in place of C.I. Pigment Yellow 74, C.I. Pigment Red 122 was used and the toner particles were made spherical so as to have a circularity of 0.941. The polyester unit components contained in the whole binder resin of the above Magenta Toner 1 are in a proportion of 100% by weight with respect to the whole binder resin of the above Magenta Toner 1. Physical properties of the toner are shown in Table 2, and the evaluation results of the running charge stability, OHP transparency and fixing performance are shown in Table 3.

Example 12

Black Toner 1 was produced, and Two-component Black Developer 1 was obtained and evaluated, in the same manner as in Example 1 except that in place of C.I. Pigment Yellow 74, carbon black was used and the toner particles were made spherical so as to have a circularity of 0.940. The polyester unit components contained in the whole binder resin of the above Black Toner 1 are in a proportion of 100% by weight with respect to the whole binder resin of the above Black Toner 1. Physical properties of the toner are shown in Table 2, and the evaluation results of the running charge stability, OHP transparency and fixing performance are shown in Table 3.

Comparative Example 4

Yellow Toner 13 was produced, and Two-component Yellow Developer 13 was obtained and evaluated, in the same manner as in Example 1 except that Resin 12 Having Polyester Unit was used as the binder resin and the toner particles were not made spherical (circularity: 0.910). The polyester unit components contained in the whole binder resin of the above Yellow Toner 13 are in a proportion of 100% by weight with respect to the whole binder resin of the above Yellow Toner 13. Physical properties of the toner are shown in Table 2, and the evaluation results of the running charge stability, OHP transparency and fixing performance are shown in Table 3.

Comparative Example 5

Yellow Toner 14 was produced, and Two-component Yellow Developer 14 was obtained and evaluated, in the same manner as in Example 1 except that Resin 7 Having Polyester Unit was used as the binder resin and the toner particles were not made spherical (circularity: 0.910). The polyester unit components contained in the whole binder resin of the above Yellow Toner 14 are in a proportion of 100% by weight with respect to the whole binder resin of the above Yellow Toner 14. Physical properties of the toner are shown in Table 2, and the evaluation results of the running charge stability, OHP transparency and fixing performance are shown in Table 3.

Comparative Example 6

Cyan Toner 2 (circularity: 0.910) was produced, and Two-component Cyan Developer 2 was obtained and evaluated, in the same manner as in Comparative Example 5 except that in place of C.I. Pigment Yellow 74, C.I. Pigment Blue 15:3 was used. The polyester unit components contained in the whole binder resin of the above Cyan Toner 2 are in a proportion of 100% by weight with respect to the whole binder resin of the above Cyan Toner 2. Physical properties of the toner are shown in Table 2, and the evaluation results of the running charge stability, OHP transparency and fixing performance are shown in Table 3.

Comparative Example 7

Magenta Toner 2 (circularity: 0.910) was produced, and Two-component Magenta Developer 2 was obtained and evaluated, in the same manner as in Comparative Example 5 except that in place of C.I. Pigment Yellow 74, C.I. Pigment Red 122 was used. The polyester unit components contained in the whole binder resin of the above Magenta Toner 2 are in a proportion of 100% by weight with respect to the whole binder resin of the above Magenta Toner 2. Physical properties of the toner are shown in Table 2, and the evaluation results of the running charge stability, OHP transparency and fixing performance are shown in Table 3.

Comparative Example 8

Black Toner 2 (circularity: 0.910) was produced, and Two-component Black Developer 2 was obtained and evaluated, in the same manner as in Comparative Example 5 except that in place of C.I. Pigment Yellow 74, carbon black was used. The polyester unit components contained in the whole binder resin of the above Black Toner 2 are in a proportion of 100% by weight with respect to the whole binder resin of the above Black Toner 2. Physical properties of the toner are shown in Table 2, and the evaluation results of the running charge stability, OHP transparency and fixing performance are shown in Table 3.

Example 13

The following running charge stability in one-component development was evaluated using Yellow Toner 1 produced in Example 1.

—Evaluation of One-component Development Running—Charge Stability This Yellow Toner 1 was evaluated using a commercially available color laser printer LBP2300 (manufactured by CANON INC.) whose process speed was set to be 150 mm/sec. A yellow cartridge of the above machine was filled with 300 g of Yellow Toner 1, and continuous printing on 5,000 sheets in a print percentage of 5% was evaluated. The triboelectric charge quantities on the sleeve at the initial stage and after 50,000-sheet running in a monochrome mode and in a high-temperature and high-humidity environment (H/H, 30° C./80% RH), a normal-temperature and low-humidity environment (N/L, 23° C./5% RH) and a normal-temperature and normal-humidity environment (N/N, 23° C./50% RH) were examined to evaluate charge stability according to the following evaluation criteria. The evaluation results are shown in Table 3.

A method for measuring the triboelectric charge quantities on the sleeve is described below in detail with reference to FIG. 2.

Figure 2:
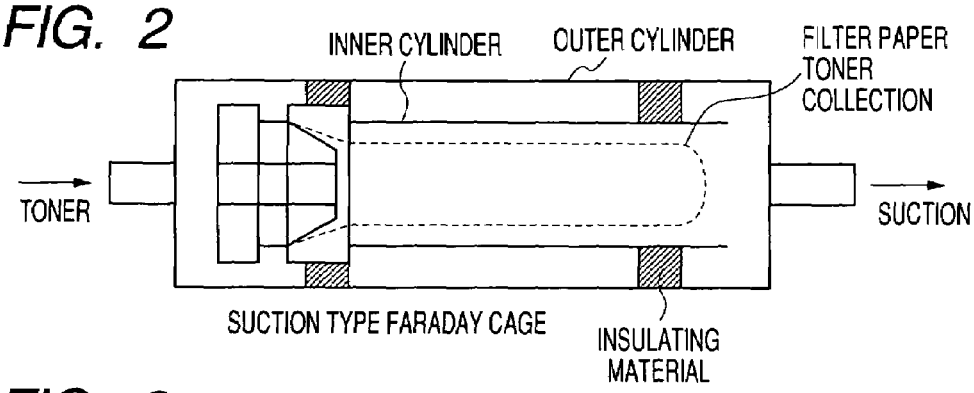
FIG. 2 illustrates a device which measures the triboelectric charge quantity of a one-component developer.

FIG. 2 illustrates a device for measuring the triboelectric charge quantity of one-component developer. The triboelectric charge quantity of the one-component developer can be measured with, e.g., such a Faraday cage as shown in FIG. 2. The Faraday cage refers to a coaxial double cylinder, where an inner cylinder and an outer cylinder are insulated from each other. If a charged body having a charge quantity Q is put in this inner cylinder, in virtue of electrostatic induction, it results in a state as if a metallic cylinder having the charge quantity Q exists. The induced charge quantity Q is measured with a KEITHLEY 616 DIGITAL ELECTROMETER, and divided by the toner weight (mass) M in the inner cylinder to find a value (Q/M) which is herein referred to as the charge quantity. The developer is directly taken into a filter by air suction from a developer carrying member. Triboelectric charge quantity (mC/kg) of one-component developer=Q/M.

(Evaluation Criteria)

A: The absolute value of the difference (Δ) between the triboelectric charge quantities at the initial stage and after the 50,000-sheet running is less than 5. (Excellent)

B: The absolute value of the difference (Δ) between the triboelectric charge quantities at the initial stage and after the 50,000-sheet running is 5 to less than 10, but no problem in practical use. (Good)

C: The absolute value of the difference (Δ) between the triboelectric charge quantities at the initial stage and after the 50,000-sheet running is 10 to less than 15, which is a little problematic in charge stability, but no problem in practical use.

(Acceptable)

D: The absolute value of the difference (Δ) between the triboelectric charge quantities at the initial stage and after the 50,000-sheet running is 15 or more, which is problematic in charge stability.

(Unacceptable)

In addition, the absolute value of the difference (Δ) between the triboelectric charge quantities at the initial stage and after the 50,000-sheet running shows the value found by subtracting the triboelectric charge quantity after the 50,000-sheet running from the triboelectric charge quantity at the initial stage [(initial-stage triboelectric charge quantity)−(after-50,000-sheet-running triboelectric charge quantity)].

Example 14

Using Two-component Yellow Developer 1, Two-component Cyan Developer 1, Two-component Magenta Developer 1 and Two-component Black Developer 1, which were produced respecrively in Example 1, Example 10, Example 11 and Example 12 in a modified machine of a full-color copying machine CLC-1000 (manufactured by CANON INC.), from a fixing unit of which an oil application mechanism was detached and in which the process speed was set to be 150 mm/sec, 50,000-sheet running tests were conducted by copying an original with an image area percentage of 28%, in a full-color mode and in a high-temperature and high-humidity environment (H/H, 30° C./80% RH), a normal-temperature and low-humidity environment (N/L, 23° C./5% RH) and a normal-temperature and normal-humidity environment (N/N, 23° C./50% RH). As a result, the charge stability was good throughout the running in each environment, and good images were obtained.

Comparative Example 9

Evaluation was made in the same manner as in Example 14 except that Two-component Yellow Developer 2, Two-component Cyan Developer 2, Two-component Magenta Developer 2 and Two-component Black Developer 2, which were produced in Comparative Example 5, Comparative Example 6, Comparative Example 7 and Comparative Example 8, respectively. The 50,000-sheet running tests were conducted by copying an original with an image area percentage of 28%, in a monochrome mode and in a high-temperature and high-humidity environment (H/H, 30° C./80% RH), a normal-temperature and low-humidity environment (N/L, 23° C./5% RH) and a normal-temperature and normal-humidity environment (N/N, 23° C./50% RH). As a result, the charge stability varied greatly throughout the running in each environment, so that the tints of images varied greatly. Also, secondary-color mixing performance was poor.

Example 15

Two-component Yellow Developer 1 used in Example 1 was evaluated in the following way.

—Evaluation of Running Charge Stability—

Using Two-component Yellow Developer 2 in an modified machine of a full-color copying machine CLC-1000 (manufactured by CANON INC.), from a fixing unit of which an oil application mechanism was detached and in which the process speed was set to 150 mm/sec, 50,000-sheet running tests were conducted by copying an original with an image area percentage of 1% in a monochrome mode and in a high-temperature and high-humidity environment (H/H, 35° C./85% RH), a normal-temperature and low-humidity environment (N/L, 23° C./1% RH) and a normal-temperature and normal-humidity environment (N/N, 23° C./50% RH). In each test, the triboelectric charge quantity (mC/kg) on the sleeve was examined at the initial stage (INI) and after the 50,000-sheet running (50 K) to evaluate charge stability according to the same evaluation criteria as in Example 1. The evaluation results on the running charge stability are shown in Table 4.

Examples 16 to 18

Two-component Yellow Developers 10 1o 12 were evaluated in the same manner as in Example 15. The evaluation results of the running charge stability are shown in Table 4.

TABLE 1

Resin physical properties

| | Catalyst | Mw ($\times 10^3$) | Mn ($\times 10^3$) | Mw/Mn | Tg (° C.) | Tm (° C.) | Acid value (mgKOH/g) |
|---|---|---|---|---|---|---|---|
| Resin Having Polyester Unit: | | | | | | | |
| 1 | Titanium chelate Exemplary Compound 3 | 25 | 3.5 | 7.1 | 62 | 110 | 34 |
| 2 | Titanium chelate Exemplary Compound 3 | 80 | 3.3 | 24.2 | 61 | 109 | 33 |
| 3 | Titanium chelate Exemplary Compounds 1 & 3 | 40 | 3.8 | 10.5 | 63 | 115 | 30 |
| 4 | Titanium chelate Exemplary Compound 2 | 40 | 3.5 | 11.4 | 62 | 114 | 31 |
| 5 | Titanium chelate Exemplary Compound 1 | 44 | 3.2 | 13.8 | 61 | 116 | 33 |
| 6 | Titanium chelate Exemplary Compound 4 | 45 | 3.7 | 12.2 | 62 | 114 | 32 |
| 7 | Tetramethyl titanate | 43 | 3.4 | 12.6 | 61 | 115 | 30 |
| 8 | Dioctyltin oxide | 42 | 3.4 | 12.4 | 62 | 114 | 32 |
| 9 | Dihydrate of titanium chelate Ex. Comp. 11 | 35 | 3.5 | 10.0 | 62 | 112 | 31 |
| 10 | Dihydrate of titanium chelate Ex. Comp. 15 | 37 | 3.1 | 11.9 | 62 | 115 | 33 |
| 11 | Dihydrate of titanium chelate Ex. Comp. 16 | 36 | 3.9 | 9.2 | 63 | 113 | 35 |
| Resin Having Vinyl Unit: | | | | | | | |
| 1 | Titanium chelate Exemplary Compound 1 | 15 | 6.4 | 2.3 | 60 | 111 | 4.6 |
| Resin Having Polyester Unit: | | | | | | | |
| 12 | Titanate of bisphenol-A EO adduct | 50 | 7.8 | 6.4 | 61 | 110 | 28 |

TABLE 2

Toner physical properties

| Toner No. | Proportion of polyester unit components (wt. %) | Catalyst | Wax | transmittance (%) | DSC maximum endothermic peak (° C.) |
|---|---|---|---|---|---|
| Yellow Toner: | | | | | |
| 1 | 100 | Titanium chelate Exemplary Compound 3 | Paraffin wax (Max. EP: 75.7° C.) | 32 | 74.9 |
| 2 | 90 | Titanium chelate Exemplary Compound 3 | Behenyl behenate (Max. EP: 71.4° C.) | 30 | 70.6 |

TABLE 2-continued

| Toner No. | Proportion of polyester unit components (wt. %) | Catalyst | Wax | transmittance (%) | DSC maximum endothermic peak (° C.) |
|---|---|---|---|---|---|
| | | Toner physical properties | | | |
| 3 | 100 | Titanium chelate Exemplary Compounds 1 & 3 | Alcohol-terminated polyethylene wax (Max. EP: 108.9° C.) | 45 | 107.9 |
| 4 | 100 | Titanium chelate Exemplary Compound 2 | Paraffin wax (Max. EP: 75.7° C.) | 35 | 74.8 |
| 5 | 90 | Titanium chelate Exemplary Compound 1 | Paraffin wax (Max. EP: 75.7° C.) | 38 | 75.0 |
| 6 | 80 | Titanium chelate Exemplary Compound 4 | Polyethylene wax (Max. EP: 126.0° C.) | 55 | 124.4 |
| 7 | 80 | Tetramethyl titanate | Polyethylene wax (Max. EP: 126.0° C.) | 55 | 124.6 |
| 8 | 80 | Dioctyltin oxide | Polyethylene wax (Max. EP: 126.0° C.) | 60 | 124.7 |
| 9 | 0 | Titanium chelate Exemplary Compound 1 | Polyethylene wax (Max. EP: 126.0° C.) | 76 | 124.3 |
| 10 | 90 | Dihydrate of titanium chelate Exemplary Compound 11 | Paraffin wax (Max. EP: 75.7° C.) | 35 | 75.0 |
| 11 | 90 | Dihydrate of titanium chelate Exemplary Compound 15 | Paraffin wax (Max. EP: 75.7° C.) | 42 | 75.3 |
| 12 | 90 | Dihydrate of titanium chelate Exemplary Compound 16 | Paraffin wax (Max. EP: 75.7° C.) | 43 | 75.1 |
| Cyan Toner: | | | | | |
| 1 | 100 | Titanium chelate Exemplary Compound 3 | Paraffin wax (Max. EP: 75.7° C.) | 30 | 74.9 |
| Magenta Toner: | | | | | |
| 1 | 100 | Titanium chelate Exemplary Compound 3 | Paraffin wax (Max. EP: 75.7° C.) | 34 | 75.1 |
| Black Toner: | | | | | |
| 1 | 100 | Titanium chelate Exemplary Compound 3 | Paraffin wax (Max. EP: 75.7° C.) | 30 | 75.0 |
| Yellow Toner: | | | | | |
| 13 | 100 | Titanate of bisphenol-A EO adduct | Paraffin wax (Max. EP: 75.7° C.) | 71 | 76.5 |
| 14 | 100 | Tetramethyl titanate | Paraffin wax (Max. EP: 75.7° C.) | 71 | 76.5 |
| Cyan Toner: | | | | | |
| 2 | 100 | Tetramethyl titanate | Paraffin wax (Max. EP: 75.7° C.) | 72 | 75.4 |
| Magenta Toner: | | | | | |
| 2 | 100 | Tetramethyl titanate | Paraffin wax (Max. EP: 75.7° C.) | 73 | 75.3 |
| Black Toner: | | | | | |
| 2 | 100 | Tetramethyl titanate | Paraffin wax (Max. EP: 75.7° C.) | 72 | 75.6 |

Max. EP: Maximum endothermic peak

TABLE 3(A)

| | | Running stability evaluation (mC/kg) | | | | | | | | | | | |
|---|---|---|---|---|---|---|---|---|---|---|---|---|---|
| | | H/H (30° C./80% RH) | | | | N/L (23° C./5% RH) | | | | N/N (23° C./50% RH) | | | |
| | Toner No. | INI | 50 K | Δ | Rank | INI | 50 K | Δ | Rank | INI | 50 K | Δ | Rank |
| | | Two-component | | | | | | | | | | | |
| Example: | | | | | | | | | | | | | |
| 1 | Yellow Toner 1 | 23.5 | 22.2 | 1.3 | A | 29.3 | 27.1 | 2.2 | A | 25.9 | 24.4 | 1.5 | A |
| 2 | Yellow Toner 2 | 24.3 | 23.1 | 1.2 | A | 30.1 | 28.0 | 2.1 | A | 27.0 | 25.3 | 1.7 | A |
| 3 | Yellow Toner 3 | 24.7 | 21.2 | 3.5 | A | 31.6 | 26.8 | 4.8 | A | 27.3 | 24.5 | 2.8 | A |

TABLE 3(A)-continued

| | | Running stability evaluation (mC/kg) | | | | | | | | | | | |
|---|---|---|---|---|---|---|---|---|---|---|---|---|---|
| | | H/H (30° C./80% RH) | | | | N/L (23° C./5% RH) | | | | N/N (23° C./50% RH) | | | |
| | Toner No. | INI | 50 K | Δ | Rank | INI | 50 K | Δ | Rank | INI | 50 K | Δ | Rank |
| 4 | Yellow Toner 4 | 23.5 | 22.2 | 1.3 | A | 30.3 | 28.0 | 2.3 | A | 26.4 | 24.8 | 1.6 | A |
| 5 | Yellow Toner 5 | 23.6 | 21.6 | 2.0 | A | 29.8 | 26.3 | 3.5 | A | 24.7 | 22.8 | 1.9 | A |
| 6 | Yellow Toner 6 | 25.8 | 23.7 | 2.1 | A | 31.7 | 28.6 | 3.1 | A | 25.0 | 23.0 | 2.0 | A |
| Comparative Example: | | | | | | | | | | | | | |
| 1 | Yellow Toner 7 | 27.7 | 17.0 | 10.7 | C | 33.6 | 26.1 | 7.5 | B | 27.0 | 20.4 | 6.6 | B |
| 2 | Yellow Toner 8 | 25.9 | 18.4 | 7.5 | B | 30.7 | 24.4 | 6.3 | B | 26.1 | 20.8 | 5.3 | B |
| 3 | Yellow Toner 9 | 24.7 | 14.6 | 10.1 | C | 33.8 | 27.0 | 6.8 | B | 28.6 | 21.8 | 6.8 | B |
| Example: | | | | | | | | | | | | | |
| 7 | Yellow Toner 10 | 24.0 | 23.7 | 0.3 | A | 29.0 | 28.2 | 0.8 | A | 25.2 | 25.0 | 0.2 | A |
| 8 | Yellow Toner 11 | 24.3 | 23.8 | 0.5 | A | 30.2 | 29.0 | 1.2 | A | 26.3 | 25.8 | 0.5 | A |
| 9 | Yellow Toner 12 | 25.2 | 24.5 | 0.7 | A | 29.8 | 28.2 | 1.6 | A | 26.8 | 26.0 | 0.8 | A |
| 10 | Cyan Toner 1 | 22.1 | 20.6 | 1.5 | A | 28.3 | 26.0 | 2.3 | A | 25.8 | 24.5 | 1.3 | A |
| 11 | Magenta Toner 1 | 23.1 | 21.8 | 1.3 | A | 28.9 | 26.5 | 2.4 | A | 25.8 | 24.4 | 1.4 | A |
| 12 | Black Toner 1 | 22.4 | 21.1 | 1.3 | A | 27.3 | 25.2 | 2.1 | A | 23.5 | 22.2 | 1.3 | A |
| Comparative Example: | | | | | | | | | | | | | |
| 4 | Yellow Toner 13 | 20.9 | 13.8 | 7.1 | B | 28.0 | 20.9 | 7.1 | B | 22.8 | 15.8 | 7.0 | B |
| | | One-component | | | | | | | | | | | |
| Example: | | | | | | | | | | | | | |
| 13 | Yellow Toner 1 | 21.5 | 20.5 | 1.0 | A | 28.9 | 25.8 | 3.1 | A | 25.0 | 23.7 | 1.3 | A |
| | | Two-component | | | | | | | | | | | |
| Comparative Example: | | | | | | | | | | | | | |
| 5 | Yellow Toner 14 | 26.5 | 15.8 | 10.7 | C | 30.8 | 21.5 | 9.3 | B | 28.5 | 21.5 | 7.0 | B |
| 6 | Cyan Toner 2 | 26.7 | 14.2 | 12.5 | C | 30.9 | 22.3 | 8.6 | B | 28.4 | 20.5 | 7.9 | B |
| 7 | Magenta Toner 2 | 26.4 | 14.3 | 12.1 | C | 29.8 | 21.1 | 8.7 | B | 27.6 | 21.3 | 6.3 | B |
| 8 | Black Toner 2 | 25.8 | 10.5 | 15.3 | D | 28.5 | 20.8 | 7.7 | B | 26.5 | 20 | 6.5 | B |

TABLE 3(B)

| | Toner No. | OHP transparency | Rank | Fixing temp. range (° C.) | Circularity |
|---|---|---|---|---|---|
| | Two-component | | | | |
| Example: | | | | | |
| 1 | Yellow Toner 1 | 90% | (A) | 130~200 | 0.941 |
| 2 | Yellow Toner 2 | 88% | (A) | 130~210 | 0.940 |
| 3 | Yellow Toner 3 | 84% | (B) | 135~205 | 0.970 |
| 4 | Yellow Toner 4 | 88% | (A) | 130~200 | 0.952 |
| 5 | Yellow Toner 5 | 87% | (A) | 135~195 | 0.933 |
| 6 | Yellow Toner 6 | 86% | (A) | 145~190 | 0.930 |
| Comparative Example: | | | | | |
| 1 | Yellow Toner 7 | 72% | (C) | 145~190 | 0.930 |
| 2 | Yellow Toner 8 | 76% | (B) | 145~190 | 0.938 |
| 3 | Yellow Toner 9 | 71% | (C) | 150~160 | 0.940 |
| Example: | | | | | |
| 7 | Yellow Toner 10 | 92% | (A) | 130~200 | 0.940 |
| 8 | Yellow Toner 11 | 91% | (A) | 130~200 | 0.939 |
| 9 | Yellow Toner 12 | 91% | (A) | 130~200 | 0.938 |
| 10 | Cyan Toner 1 | 91% | (A) | 130~200 | 0.940 |
| 11 | Magenta Toner 1 | 91% | (A) | 130~200 | 0.941 |
| 12 | Black Toner 1 | — | | 130~200 | 0.940 |

TABLE 3(B)-continued

| | Toner No. | OHP transparency | Rank | Fixing temp. range (° C.) | Circularity |
|---|---|---|---|---|---|
| Comparative Example: | | | | | |
| 4 | Yellow Toner 13 | 83% | (B) | 130~200 | 0.910 |
| | One-component | | | | |
| Example: | | | | | |
| 13 | Yellow Toner 1 | 90% | (A) | 130~200 | 0.941 |
| | Two-component | | | | |
| Comparative Example: | | | | | |
| 5 | Yellow Toner 14 | 71% | (C) | 135~185 | 0.910 |
| 6 | Cyan Toner 2 | 70% | (C) | 135~185 | 0.910 |
| 7 | Magenta Toner 2 | 71% | (C) | 135~185 | 0.910 |
| 8 | Black Toner 2 | — | | 135~185 | 0.910 |

TABLE 4

| | | Running stability evaluation (mC/kg) | | | | | | | | | | | |
|---|---|---|---|---|---|---|---|---|---|---|---|---|---|
| | | H/H (35° C./85% RH) | | | | N/L (23° C./1% RH) | | | | N/N (23° C./50% RH) | | | |
| Example: | Toner No. | INI | 50 K | Δ | Rank | INI | 50 K | Δ | Rank | INI | 50 K | Δ | Rank |
| | | Two-component | | | | | | | | | | | |
| 15 | Yellow Toner 1 | 20.0 | 12.8 | 7.2 | B | 34.2 | 28.2 | 6.0 | B | 25.9 | 20.8 | 5.1 | B |
| 16 | Yellow Toner 10 | 20.3 | 17.2 | 3.1 | A | 34.2 | 32.8 | 1.4 | A | 26.6 | 25.2 | 1.4 | A |
| 17 | Yellow Toner 11 | 20.8 | 16.3 | 4.5 | A | 35.2 | 31.7 | 3.5 | A | 25.8 | 22.3 | 3.5 | A |
| 18 | Yellow Toner 12 | 20.3 | 15.8 | 4.5 | A | 34.3 | 30.4 | 3.9 | A | 24.3 | 20.5 | 3.8 | A |

What is claimed is:

1. A toner comprising toner particles containing at least a binder resin, a colorant and a wax, and inorganic fine particles, wherein said binder resin is a resin having at least a polyester unit;

said binder resin having a polyester unit is a resin synthesized by using as a catalyst one or more compounds selected from the group consisting of titanium chelate compounds each having a structure represented by any one of the following Formulas (I) to (VI), and hydrates of the titanium chelate compounds;

(I)

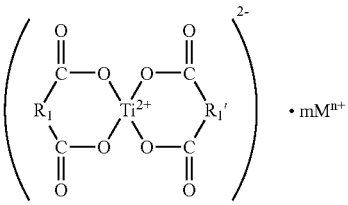

wherein $R_1$ and $R_1'$ each independently represent an alkylene group having 1 to 10 carbon atoms which may have a substituent, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(II)

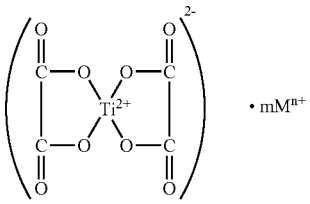

wherein M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(III)

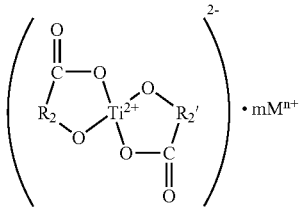

wherein $R_2$ and $R_2'$ each independently represent an alkylene group having 1 to 10 carbon atoms which may have a substituent, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(IV)

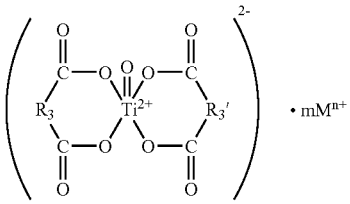

wherein $R_3$ and $R_3'$ each independently represent an alkylene group having 1 to 10 carbon atoms which may be substituted, or an alkenylene group having 1 to 10 carbon atoms which may have a substituent; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(V)

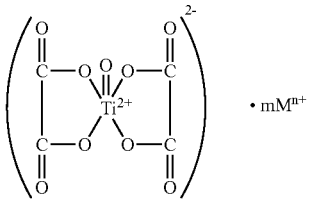

wherein M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2; and (VI)

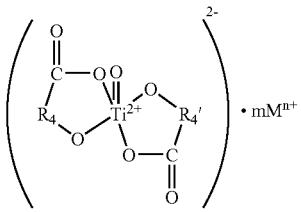

wherein $R_4$ and $R_4'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

2. The toner according to claim 1, wherein said inorganic fine particles are at least one of fine titanium oxide particles and fine silica particles.

3. The toner according to claim 1, wherein said toner has a light transmittance (%) of 600 nm wavelength light from 10% to 70% in an aqueous solution containing methanol 45 vol. %.

4. The toner according to claim 1, which comprises an aromatic carboxylic metal compound.

5. The toner according to claim 1, which has, in an endothermic curve as measured by a differential scanning calorimeter (DSC), a maximum endothermic peak in a temperature range of from 30° C. to 200° C. and a peak temperature thereof in the range of from 60° C. to 130° C.

6. The toner according to claim 1, which has an average circularity of from 0.930 to 0.990 as measured by a flow type particle image analyzer.

7. The toner according to claim 1, which is a non-magnetic toner.

8. An image forming method comprising:

a charging step of applying a voltage to a charging member to charge an image bearing member;

an electrostatic latent image formation step of forming an electrostatic latent image on the image bearing member thus charged;

a developing step of developing the electrostatic latent image by the use of a toner held on the surface of the toner carrying member, to form a toner image on the surface of the image bearing member;

a transfer step of transferring the toner image formed on the image bearing member, to a transfer material via, or not via, an intermediate transfer member; and a fixing step of fixing the toner image by heat and pressure;

said toner comprising at least toner particles containing at least a binder resin, a colorant and a wax, and inorganic fine particles;

wherein;

said binder resin is a resin having at least a polyester unit, and the binder resin having a polyester unit is a resin synthesized by using as a catalyst one or more compound(s) selected from the group consisting of titanium chelate compounds each having a structure represented by any one of the following Formulas (I) to (VI), and hydrates of the titanium chelate compounds;

(I)

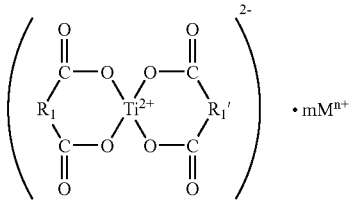

wherein $R_1$ and $R_1'$ each independently represent an alkylene group having 1 to 10 carbon atoms which may be substituted, or an alkenylene group having 1 to 10 carbon atoms which may be substituted; and M represents a counter cation, m represents the number cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(II)

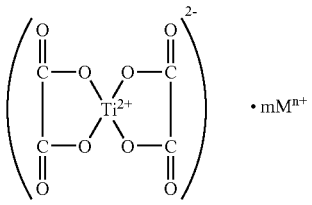

wherein M represents a counter cation, m represents a number of the cation, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(III)

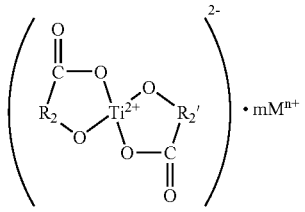

wherein $R_2$ and $R_2'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(IV)

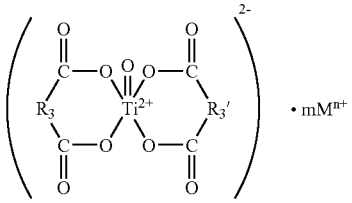

wherein $R_3$ and $R_3'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2;

(V)

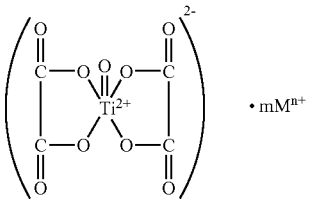

wherein M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2; and (VI)

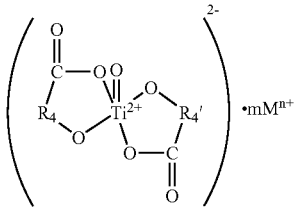

wherein $R_4$ and $R_4'$ each independently represent an alkylene group having 1 to 10 carbon atoms which may be substituted, or an alkenylene group having 1 to 10 carbon atoms which may be substituted; and M represents a counter cation, m represents the number of cations, and n represents a valence number of the cation, where n is 2 when m is 1, n is 1 when m is 2, and M represents a hydrogen ion, an alkali metal ion, an ammonium ion or an organoammonium ion when n is 1, and represents an alkaline earth metal ion when n is 2.

9. The image forming method according to claim 8, which is a full color image forming method.

10. The image forming method according to claim 8, wherein said inorganic fine particles are at least one of fine titanium oxide particles and fine silica particles.

11. The image forming method according to claim 8, wherein said toner has a light transmittance (%) of 600 nm wavelength light of from 10% to 70% in an aqueous solution containing methanol 45 vol. %.

12. The image forming method according to claim 8, wherein said toner comprises an aromatic carboxylic metal compound.

13. The image forming method according to claim 8, wherein said toner has, in an endothermic curve as measured by a differential scanning calorimeter (DSC), a maximum endothermic peak in a temperature range of from 30° C. to 200° C. and a peak temperature thereof in the range of from 60° C. to 130° C.

14. The image forming method according to claim 8, wherein said toner has an average circularity of from 0.930 to 0.990 as measured by a flow type particle image analyzer.

15. The image forming method according to claim 8, wherein said toner is a non-magnetic toner.

* * * * *

UNITED STATES PATENT AND TRADEMARK OFFICE

CERTIFICATE OF CORRECTION

PATENT NO. : 7,297,455 B2
APPLICATION NO. : 10/900177
DATED : November 20, 2007
INVENTOR(S) : Hiroyuki Fujikawa et al.

It is certified that error appears in the above-identified patent and that said Letters Patent is hereby corrected as shown below:

ON THE TITLE PAGE [*]:

Notice, --This patent is subject to a terminal disclaimer.-- should be inserted.

ON THE TITLE PAGE [45]:

Date of Patent, "Nov. 20, 2007" should read --*Nov. 20, 2007--.

COLUMN 1:

Line 5, "is" should read --are--.

COLUMN 2:

Line 65, "filfilled," should read --fulfilled,--.

COLUMN 5:

Line 19, "pressure;" should read --pressure,--;
Line 22, "particles; ¶" should read --particles,--; and
Line 23, "wherein;" should read --wherein--.

COLUMN 9:

Line 35, "p-ethylstyrenee," should read --p-ethylstyrene,--; and
Line 36, "p-n-hexystyelene," should read --p-n-hexylstyrene--.

COLUMN 13:

Line 14, "cation," should read --cations,--.

COLUMN 15:

Line 37, "If" should read --If,-- and
"hand" should read --hand,--; and
Line 47, "strontium" should read --strontium,--.

COLUMN 18:

Line 60, "is" should read --are--.

UNITED STATES PATENT AND TRADEMARK OFFICE

CERTIFICATE OF CORRECTION

PATENT NO. : 7,297,455 B2
APPLICATION NO. : 10/900177
DATED : November 20, 2007
INVENTOR(S) : Hiroyuki Fujikawa et al.

It is certified that error appears in the above-identified patent and that said Letters Patent is hereby corrected as shown below:

COLUMN 21:

Line 46, “present” should read --present invention--.

COLUMN 22:

Line 28, “4.9,” should read --49,--; and
Line 65, “0.17,” should read --17,--.

COLUMN 27:

Line 17, “Kikai K.K.).” should read --Kikai K.K. is used.--;
Line 22, “provide” should read --provides--;
Line 43, “and” should read --and after--; and
Line 61, “10°C./min)” should read --10°C./min).--.

COLUMN 28:

Line 26, “form” should read --from--.

COLUMN 29:

Line 47, “are” should read --is--;
Line 52, “intersect” should be deleted;
Line 55, “point-can” should read --point can--; and
Line 59, “1,960 N/m” should read --1,960 $N/m^2$--.

COLUMN 32:

Line 11, “after” should read --after being--.

COLUMN 38:

Line 37, “use.” should read --use. (Acceptable)--;
Line 39, “(Acceptable)” should be deleted;
Line 43, “stability.” should read --stability. (Unacceptable)--; and
Line 45, “(Unacceptable)” should be deleted.

UNITED STATES PATENT AND TRADEMARK OFFICE

CERTIFICATE OF CORRECTION

PATENT NO. : 7,297,455 B2
APPLICATION NO. : 10/900177
DATED : November 20, 2007
INVENTOR(S) : Hiroyuki Fujikawa et al.

It is certified that error appears in the above-identified patent and that said Letters Patent is hereby corrected as shown below:

COLUMN 41:

Line 10, "100%" should read --0%--.

COLUMN 43:

Line 49, "ning—Charge Stability" should read --ning Charge Stability—¶--.

COLUMN 44:

Line 8, "in" (second occurrence) should read --by--;
Line 31, "use." should read --use. (Acceptable)--;
Line 33, "(Acceptable)" should be deleted;
Line 37, "stability." should read --stability. (Unacceptable)--;
Line 39, "(Unacceptable)" should be deleted; and
Line 54, "respectively" should read --respectively, were used.--.

COLUMN 45:

Line 9, "respectively." should read --respectively, were used.--.

COLUMN 46:

Line 2, "Developer 2" should read --Developer 1-- and
"an" should read --a--; and
Line 22, "1o" should read --to--.

COLUMN 53:

Line 67, "particles; ¶" should read --particles,--.

COLUMN 54:

Line 1, "wherein;" should read --wherein--; and
Line 26, "number" should read --number of--.

UNITED STATES PATENT AND TRADEMARK OFFICE

CERTIFICATE OF CORRECTION

PATENT NO. : 7,297,455 B2
APPLICATION NO. : 10/900177
DATED : November 20, 2007
INVENTOR(S) : Hiroyuki Fujikawa et al.

It is certified that error appears in the above-identified patent and that said Letters Patent is hereby corrected as shown below:

COLUMN 56:

Line 24, "full color" should read --full-color--.

Signed and Sealed this

Twenty-fourth Day of February, 2009

JOHN DOLL
*Acting Director of the United States Patent and Trademark Office*